US008083585B2

(12) United States Patent
Brosnan

(10) Patent No.: US 8,083,585 B2
(45) Date of Patent: Dec. 27, 2011

(54) APPARATUS AND METHOD FOR COPYING GAMING MACHINE CONFIGURATION SETTINGS

(75) Inventor: Bill Brosnan, Reno, NV (US)

(73) Assignee: IGT, Reno, NV (US)

( * ) Notice: Subject to any disclaimer, the term of this patent is extended or adjusted under 35 U.S.C. 154(b) by 1244 days.

(21) Appl. No.: 10/238,354

(22) Filed: Sep. 10, 2002

(65) Prior Publication Data

US 2004/0048668 A1 Mar. 11, 2004

(51) Int. Cl.
*A63F 9/24* (2006.01)

(52) U.S. Cl. ..... 463/29

(58) Field of Classification Search ..... 463/16–22, 463/25, 29, 40–45; 380/251, 23; 713/172
See application file for complete search history.

(56) References Cited

U.S. PATENT DOCUMENTS

| | | | | |
|---|---|---|---|---|
| 3,931,504 | A | 1/1976 | Jacoby | |
| 4,072,930 | A * | 2/1978 | Lucero et al. | 463/47 |
| 4,430,728 | A | 2/1984 | Beitel et al. | |
| 4,454,594 | A | 6/1984 | Heffron et al. | |
| 4,558,413 | A | 12/1985 | Schmidt et al. | |
| 4,856,787 | A | 8/1989 | Itkis | |
| 4,948,138 | A | 8/1990 | Pease et al. | |
| 5,102,138 | A | 4/1992 | Johnson | |
| 5,136,644 | A | 8/1992 | Audebert et al. | |
| 5,155,837 | A | 10/1992 | Liu et al. | |
| 5,293,424 | A * | 3/1994 | Holtey et al. | 713/193 |
| 5,326,104 | A | 7/1994 | Pease et al. | |
| 5,410,703 | A | 4/1995 | Nilsson et al. | |
| 5,421,009 | A | 5/1995 | Platt | |
| 5,421,017 | A | 5/1995 | Scholz et al. | |
| 5,469,573 | A | 11/1995 | McGill, III et al. | |
| 5,473,772 | A | 12/1995 | Halliwell et al. | |
| 5,555,418 | A | 9/1996 | Nilsson et al. | |
| 5,643,086 | A | 7/1997 | Alcorn et al. | |
| 5,654,746 | A | 8/1997 | McMullan, Jr. et al. | |
| 5,655,961 | A | 8/1997 | Acres et al. | |
| 5,671,412 | A | 9/1997 | Christiano | |
| 5,682,533 | A | 10/1997 | Siljestroemer | |
| 5,707,286 | A | 1/1998 | Carlson | |
| 5,715,403 | A | 2/1998 | Stefik | |
| 5,715,462 | A | 2/1998 | Iwamoto et al. | |

(Continued)

FOREIGN PATENT DOCUMENTS

AU 2003204180 4/2003

(Continued)

OTHER PUBLICATIONS

Great Britian Search Report for Application No. 0320739.6 dated Feb. 2, 2004.

(Continued)

*Primary Examiner* — Omkar Deodhar
(74) *Attorney, Agent, or Firm* — Weaver Austin Villeneuve & Sampson LLP

(57) ABSTRACT

Disclosed is an apparatus and method for use in a casino gaming system where data concerning set-up configuration of gaming units may be copied from one gaming unit to another gaming unit. The data concerning gaming unit configuration may be copied via an external device, such as a smart storage device or a dumb storage device, copied directly between gaming units or copied via a network storage device of a network that interconnects gaming units.

13 Claims, 18 Drawing Sheets

U.S. PATENT DOCUMENTS 5,759,102 A 6/1998 Pease et al.
5,761,647 A 6/1998 Boushy
5,762,552 A 6/1998 Vuong et al.
5,768,271 A 6/1998 Seid et al.
5,768,382 A 6/1998 Schneier et al.
5,770,533 A 6/1998 Franchi
5,779,545 A 7/1998 Berg et al.
5,836,817 A 11/1998 Acres et al.
5,845,077 A 12/1998 Fawcett
5,845,090 A 12/1998 Collins et al.
5,848,064 A 12/1998 Cowan
5,851,149 A 12/1998 Xidos et al.
5,870,723 A 2/1999 Pare, Jr. et al.
5,885,158 A 3/1999 Torango et al.
5,896,566 A 4/1999 Acerbuch et al.
5,905,523 A 5/1999 Woodfield et al.
5,915,024 A 6/1999 Kitaori et al.
5,925,127 A 7/1999 Ahmad
5,937,066 A 8/1999 Gennaro et al.
5,954,583 A * 9/1999 Green ..... 463/29
5,970,143 A 10/1999 Schneier et al.
5,978,381 A 11/1999 Perlman et al.
5,999,740 A 12/1999 Rowley
5,999,808 A 12/1999 LaDue
6,002,772 A 12/1999 Saito
6,006,034 A 12/1999 Heath et al.
6,009,177 A 12/1999 Sudia
6,029,046 A 2/2000 Khan et al.
6,047,128 A 4/2000 Zander
6,052,512 A 4/2000 Peterson et al.
6,092,147 A 7/2000 Levy
6,099,408 A 8/2000 Schneier et al.
6,104,815 A 8/2000 Alcorn et al.
6,106,396 A 8/2000 Alcorn et al.
6,125,185 A 9/2000 Boesch
6,135,887 A 10/2000 Pease et al.
6,149,522 A 11/2000 Alcorn et al.
6,154,878 A 11/2000 Saboff
6,165,072 A 12/2000 Davis et al.
6,169,976 B1 1/2001 Colosso
6,178,510 B1 1/2001 O'Connor et al.
6,253,374 B1 6/2001 Dresevic et al.
6,264,561 B1 7/2001 Saffari et al.
6,266,810 B1 7/2001 Tanaka et al.
6,270,410 B1 8/2001 DeMar et al.
6,272,223 B1 8/2001 Carlson
6,285,868 B1 9/2001 LaDue
6,285,886 B1 9/2001 Kamel et al.
6,293,866 B1 9/2001 Walker et al.
6,308,273 B1 10/2001 Goertezel et al.
6,317,827 B1 11/2001 Cooper
6,364,769 B1 4/2002 Weiss et al.
6,368,219 B1 4/2002 Szrek et al.
6,439,996 B2 8/2002 LeMay et al.
6,446,257 B1 9/2002 Pradhan et al.
6,449,687 B1 9/2002 Moriya
6,453,319 B1 9/2002 Mattis et al.
6,454,648 B1 9/2002 Kelly et al.
6,488,581 B1 12/2002 Stockdale
6,508,709 B1 1/2003 Karmarkar
6,519,730 B1 2/2003 Ando et al.
6,574,612 B1 6/2003 Baratti et al.
6,704,871 B1 3/2004 Kaplan et al.
6,805,634 B1 10/2004 Wells et al.
6,980,521 B1 12/2005 Jarvis
7,043,641 B1 5/2006 Martinek et al.
7,076,061 B1 7/2006 Lenstra et al.
7,127,069 B2 10/2006 Nguyen
7,142,676 B1 11/2006 Hillier et al.
7,168,089 B2 1/2007 Nguyen et al.
7,260,834 B1 8/2007 Carlson
7,319,759 B1 1/2008 Peinado et al.
7,371,166 B1 5/2008 Webb et al.
7,515,718 B2 4/2009 Nguyen et al.
2002/0022521 A1 2/2002 Idaka
2002/0034299 A1 * 3/2002 Charrin ..... 380/251
2002/0045477 A1 4/2002 Dabrowski
2002/0049909 A1 4/2002 Jackson et al.
2002/0071557 A1 6/2002 Nguyen
2002/0116615 A1 8/2002 Nguyen et al.
2002/0137217 A1 9/2002 Rowe
2002/0155887 A1 10/2002 Criss-Puszkiewicz et al.
2002/0183110 A1 * 12/2002 Flanagan-Parks et al. ..... 463/25
2003/0054880 A1 3/2003 Lam et al.
2003/0064771 A1 4/2003 Morrow et al.
2003/0134675 A1 7/2003 Oberberger
2003/0188306 A1 10/2003 Harris et al.
2003/0216182 A1 11/2003 Gauselmann
2004/0002385 A1 1/2004 Nguyen
2004/0009815 A1 * 1/2004 Zotto et al. ..... 463/42
2004/0209660 A1 10/2004 Carlson et al.
2004/0242324 A9 * 12/2004 Walker et al. ..... 463/40
2004/0266533 A1 12/2004 Gentles et al.
2005/0192099 A1 9/2005 Nguyen et al.
2006/0128460 A1 6/2006 Muir et al.
2006/0150246 A1 7/2006 Kamada et al.
2007/0026935 A1 2/2007 Wolf et al.
2007/0026942 A1 2/2007 Kinsley et al.
2007/0061885 A1 3/2007 Hammes et al.
2007/0118646 A1 5/2007 Gassoway
2007/0136817 A1 6/2007 Nguyen
2008/0214300 A1 9/2008 Williams et al.

FOREIGN PATENT DOCUMENTS

AU 2007 237 259 1/2011
AU 2008 243 213 4/2011
EP 0 689 325 12/1995
EP 0 706 275 4/1996
EP 0 715 245 6/1996
EP 0 744 786 11/1996
EP 0 841 615 5/1998
EP 0 905 614 3/1999
EP 1 001 391 5/2000
EP 1 001 391 A2 5/2000
EP 1 004 970 5/2000
EP 1 029 570 8/2000
EP 1 029 570 A2 8/2000
EP 1 061 430 12/2000
EP 1 074 955 2/2001
EP 1 363 252 11/2003
EP 1 363 252 A2 11/2003
EP 1 574 928 A2 9/2005
FR 2 829 892 3/2003
JP 2008-293921 11/1996
WO WO 95/24689 9/1995
WO WO 96/00950 1/1996
WO WO 99/01188 1/1999
WO 00/11565 3/2000
WO WO 00/011565 3/2000
WO WO 00/11565 A2 3/2000
WO WO 01/20424 3/2001
WO 01/99067 12/2001
WO WO 01/099067 12/2001
WO WO01/99067 12/2001
WO WO 02/05229 1/2002
WO 02/077935 10/2002
WO WO 02/077935 10/2002
WO 02/089935 11/2002
WO WO 02/089935 11/2002
WO WO 02/089935 A1 11/2002
WO WO 03/085613 10/2003
WO WO 2007/041700 4/2007
WO WO 09/140211 11/2009

OTHER PUBLICATIONS

S. Sonoda., "FreyaOS: The Operating System Makes a Small Computer on the Portable Game Machine," Computer System Symposium, vol. 2000, No. 13, pp. 9-16, Information Processing Society of Japan (Nov. 15, 2000) (with partial translation, 2 pages).

"Java 2 Micro Entertainment," JAVA Press, vol. 14, pp. 200-215 (Oct. 12, 2000) (with partial translation, 1 page).

Hiroaki Higaki, "Group Communication Algorithm for Dynamically Updating in Distributed Systems" Copyright 1994 IEEE International Conference on Parallel and Distributed Sytems (pp. 56-62) 08-8186-655 Jun. 1994, higaki@sdesun.slab.ntt.jp.

Steffen Hauptmann et al., "On-line Maintenance with On-the-Fly Software Replacement" Copyright 1996 IEEE Proceedings, Third International Conference on Configurable Distributed Systems, (pp. 70-80) 0-8186-7395 Aug. 1996.
Hiroaki Higaki, "Extended Group Communication Algorithm for Updating Dynamically Programs" Copyright 1996, IEEE, International Conference on Parallel and Distributed Sytems 08-8186-7267 Jun. 1996, hig@takilab.k.dendai.as.jp.
Non-final Office Action dated for U.S. Appl. No. 09/732,650 dated May 20, 2004.
Final Office Action for U.S. Appl. No. 09/732,650 dated Feb. 25, 2005.
Non-final Office Action for U.S. Appl. No. 09/732,650 dated Jun. 8, 2005.
Notice of Allowance for U.S. Appl. No. 09/732,650 dated May 20, 2004.
Allowed Claims for U.S. Appl. No. 09/732,650.
Non-final Office Action for U.S. Appl. No. 10/116,424 dated Feb. 8, 2006.
Notice of Allowance for U.S. Appl. No. 10/116,424 dated Sep. 18, 2006.
Allowed Claims for U.S. Appl. No. 10/116,424.
Non-Final Office Action for U.S. Appl. No. 11/078,966 dated May 13, 2008.
International Search Report mailed Aug. 7, 2003 and Written Opinion dated Nov. 5, 2003 from corresponding PCT Application No. PCT/US2003/09669, 3 pages.
International Search Report dated Jul. 19, 2006 from corresponding PCT Application No. PCT/US2006/008785, 11 pages.
Written Opinion dated Jul. 19, 2006 from corresponding PCT Application No. PCT/US2006/008785, 11 pages.
Office Action for AU Patent Application 97154/01 dated Sep. 29, 2005.
Office Action for EP Patent Application 06 737 915.6-2221 dated Nov. 23, 2007.
Office Action for EP Patent Application 06 737 915.6-2221 dated Jul. 8, 2008.
Russian Office Action dated Jan. 25, 2007 from related RU Application No. 2004129600.
Russian Office Action dated Jul. 5, 2007 from related RU Application No. 2004129600.
Russian Office Action dated Jan. 30, 2008 from related RU Application No. 2004129600.
Search Report dated Jan. 30, 2004 for GB Patent Application No. GB 0320739.6.
Exam Report dated Jun. 30, 2005 for GB Patent Application No. GB 0320739.6.
Combined Search and Examination Report dated Jun. 23, 2006 for GB Patent Application No. GB0608549.2.
Office Action letter dated from Foreign Associate Dec. 13, 2005 for JP Patent Application No. 2003-317877.
Office Action mailed Mar. 31, 2006 in Australian Patent Application No. 2003244619.
Notice of Allowance for U.S. Appl. No. 11/078,966 dated Nov. 28, 2008.
Australian Office Action dated Jul. 3, 2008 from related AU Application No. 2003231979.
International Search Report and Written Opinion dated Dec. 5, 2008 from related PCT Application No. PCT/US2008/052561, 12 pgs.
Non-Final Office Action for U.S. Appl. No. 11/078,966 dated Mar. 26, 2010.
Australian Office Action dated Aug. 28, 2009 from Application No. 2007237259.
Australian Office Action dated Jun. 18, 2010 from Application No. 2007237259.
Australian Statement of Grounds and Particulars dated May 29, 2009 from Application No. 2003231979.
Australian Office Action dated Mar. 4, 2010 from Application No. 2006201450.
Chinese Office Action dated Nov. 6, 2009 from Application No. 200680013919.8.
International Search Report and Written Opinion date Aug. 14, 2009, issued in PCT/US2009/043492.
Allowed Claims for U.S. Appl. No. 11/078,966.
US Office Action dated Mar. 26, 2010 issued in U.S. Appl. No. 11/701,921.
US Office Action dated Jan. 28, 2011 issued in U.S. Appl. No. 12/120,205.
US Examiner Interview Summary dated May 4, 2011 issued in U.S. Appl. No. 12/120,205.
US Final Office Action dated May 26, 2011 issued in U.S. Appl. No. 12/120,205.
US Examiner Interview Summary dated Aug. 18, 2011 issued in U.S. Appl. No. 12/120,205.
Canadian Office Action dated Jun. 4, 2010 issued in CA 2,364,424.
Canadian Office Action dated Apr. 12, 2011 issued in CA 2,364,424.
Canadian Office Action dated Jan. 26, 2011 issued in CA 2,481,062.
European Office Action dated Jun. 22, 2010 issued in EP 0 346 074.8.
Australian Office Action dated Sep. 16, 2010 issued in AU 2006223202.
Chinese Office Action dated Aug. 27, 2010 issued in CN 200680013919.8.
PCT International Preliminary Report on Patentability and Written Opinion dated Nov. 25, 2010 issued in PCT/US2009/043492.
Martinek et al., "Encryption in a Secure Computerized Gaming System" U.S. Appl. No. 09/520,404 filed Mar. 8, 2000.

* cited by examiner

FIG. 10
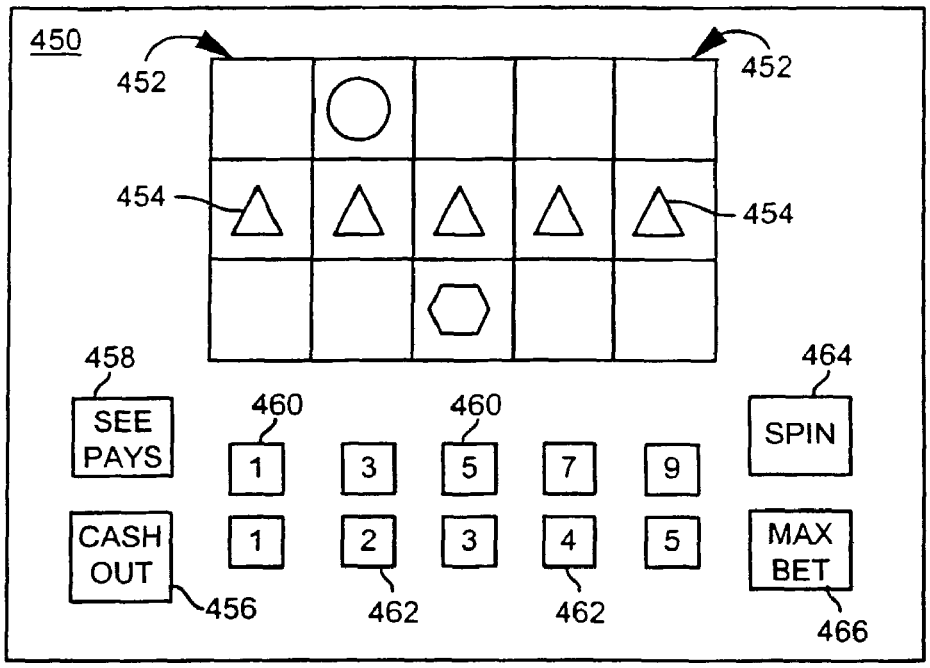
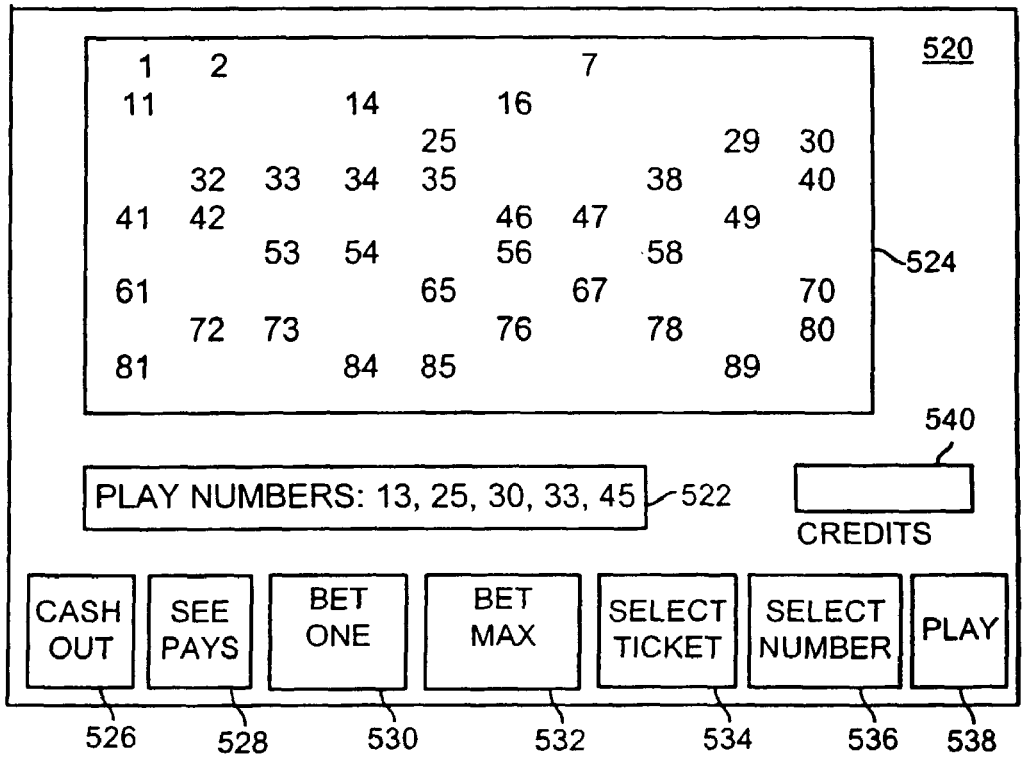
FIG. 11

APPARATUS AND METHOD FOR COPYING GAMING MACHINE CONFIGURATION SETTINGS

BACKGROUND

The present invention is directed to gaming machines of the type that may be found in a casino and, more particularly, to apparatuses and methods for copying configuration settings from one gaming machine to another gaming machines.

A general type of conventional gaming machines has been provided with a display unit that is capable of generating video images, a value input device, a processor that controls the overall operation of the gaming machine and a memory that may store particular configuration settings or data concerning how an operator of the gaming machine desires the particular machine to be configured. The processor, for example, may utilize particular configuration data stored in the memory to control such items as the volume of particular sounds issued by the machine during various periods of game play, display options of the video images displayed on the display unit, the accepted denomination of the values input to the gaming device or how particular promotional gaming credits are awarded and accepted by the gaming machine. Typically, the conventional gaming machine memory stores hundreds of particular configuration settings. These configuration settings typically may be programmed by the casino on an individual machine basis. That is, a casino operator may interface the processor and memory via an interface and select particular settings in order to configure the gaming machine as desired. In casinos having large numbers of gaming machines, of which several of the gaming machines may be configured identically, setting the configuration settings of each of these gaming machines on a one by one basis becomes time consuming and burdensome.

SUMMARY OF THE INVENTION

According to an aspect of the present invention, a gaming apparatus is disclosed including a display unit that is capable of generating video images, a value input device, a controller operatively coupled to the display unit and the value input device, the controller including a processor and a memory operatively coupled to said processor. The controller is programmed to allow a person to make a wager and to cause a video image representing a game to be generated on said display unit. The video image represents one of the following games: video poker, video blackjack, video slots, video keno or video bingo. The video image includes an image of at least five playing cards if the game comprises video poker, an image of a number of simulated slot machine reels if the game comprises video slots, an image of a number of playing cards if the game comprises video blackjack, an image of a number of keno numbers if the game comprises video keno, and an image of a bingo grid if the game comprises video bingo. The controller is also programmed to determine a value payout associated with an outcome of the game. Additionally, the controller is programmed to automatically download or upload configuration items between the memory and an external device when the gaming apparatus is connected with the external device. The configuration items comprise data related to predetermined configuration settings of said gaming apparatus.

According to another aspect of the invention, a method is disclosed for copying configuration data from a first gaming machine to a second gaming machine. The method includes connecting an external device to the first gaming machine via an interface port; causing a copying routine to be performed at least within the first gaming machine; determining whether the second gaming machine or the external device is authorized to receive the configuration data; uploading at least a portion of the configuration data to the external device if the external device is authorized to receive the configuration data; and downloading the configuration data from the external device to the second gaming machine if the second gaming device is authorized to receive the configuration data.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

FIG. 10 is an illustration of an embodiment of a visual display that may be displayed during performance of the slots routine of FIG. 12;

FIG. 11 is an illustration of an embodiment of a visual display that may be displayed during performance of the video keno routine of FIG. 13;

DETAILED DESCRIPTION OF VARIOUS EMBODIMENTS

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, it is not intended that the scope of any claim element be interpreted based on the application of 35 U.S.C. §112, sixth paragraph.

Figure 1:
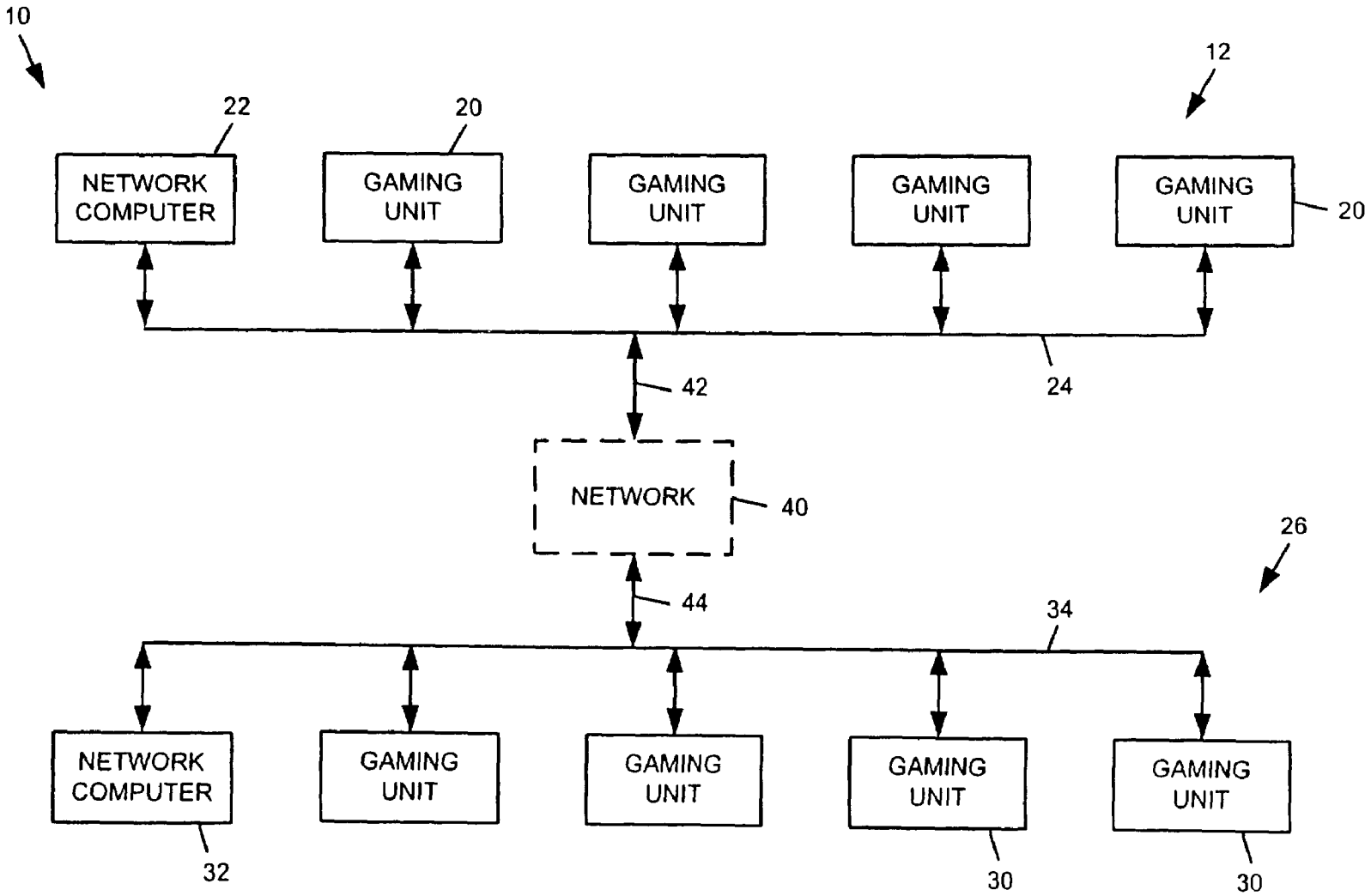
FIG. 1 is a block diagram of an embodiment of a gaming system in accordance with the invention.

FIG. 1 illustrates one possible embodiment of a casino gaming system 10 in accordance with the teachings of the invention. Referring to FIG. 1, the casino gaming system 10 may include a first group or network 12 of casino gaming units 20 operatively coupled to a network computer 22 via a network data link or bus 24. The casino gaming system 10 may include a second group or network 26 of casino gaming units 30 operatively coupled to a network computer 32 via a network data link or bus 34. The first and second gaming networks 12, 26 may be operatively coupled to each other via a network 40, which may comprise, for example, the Internet, a wide area network (WAN), or a local area network (LAN) via a first network link 42 and a second network link 44.

The first network 12 of gaming units 20 may be provided in a first casino, and the second network 26 of gaming units 30 may be provided in a second casino located in a separate geographic location than the first casino. For example, the two casinos may be located in different areas of the same city, or they may be located in different states. The network 40 may include a plurality of network computers or server computers (not shown), each of which may be operatively interconnected. Where the network 40 comprises the Internet, data communication may take place over the communication links 42, 44 via an Internet communication protocol.

The network computer 22 may be a server computer and may be used to accumulate and analyze data relating to the operation of the gaming units 20. For example, the network computer 22 may continuously receive data from each of the gaming units 20 indicative of the dollar amount and number of wagers being made on each of the gaming units 20, data indicative of how much each of the gaming units 20 is paying out in winnings, data regarding the identity and gaming habits of players playing each of the gaming units 20, etc. The network computer 32 may be a server computer and may be used to perform the same or different functions in relation to the gaming units 30 as the network computer 22 described above.

Although each network 12, 26 is shown to include one network computer 22, 32 and four gaming units 20, 30, it should be understood that different numbers of computers and gaming units may be utilized. For example, the network 12 may include a plurality of network computers 22 and tens or hundreds of gaming units 20, all of which may be interconnected via the data link 24. The data link 24 may provided as a dedicated hardwired link or a wireless link. Although the data link 24 is shown as a single data link 24, the data link 24 may comprise multiple data links.

Figure 2:
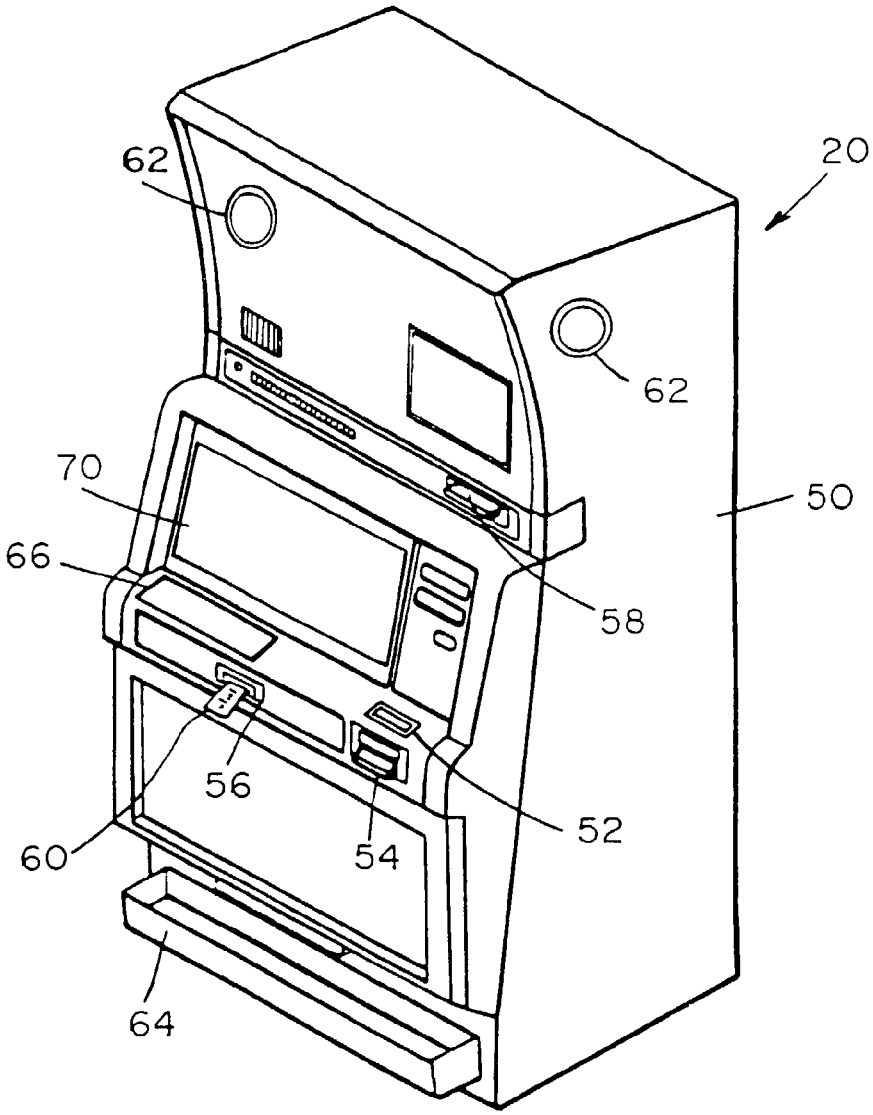
FIG. 2 is a perspective view of an embodiment of one of the gaming units shown schematically in FIG. 1.

FIG. 2 is a perspective view of one possible embodiment of one or more of the gaming units 20. Although the following description addresses the design of the gaming units 20, it should be understood that the gaming units 30 may have the same design as the gaming units 20 described below. It should be understood that the design of one or more of the gaming units 20 may be different than the design of other gaming units 20, and that the design of one or more of the gaming units 30 may be different than the design of other gaming units 30. Each gaming unit 20 may be any type of casino gaming unit and may have various different structures and methods of operation. For exemplary purposes, various designs of the gaming units 20 are described below, but it should be understood that numerous other designs may be utilized.

Referring to FIG. 2, the casino gaming unit 20 may include a housing or cabinet 50 and one or more input devices, which may include a coin slot or acceptor 52, a paper currency acceptor 54, a ticket reader/printer 56 and a card reader 58, which may be used to input value to the gaming unit 20. A value input device may include any device that can accept value from a customer. As used herein, the term "value" may encompass gaming tokens, coins, paper currency, ticket vouchers, credit or debit cards, and any other object representative of value.

If provided on the gaming unit 20, the ticket reader/printer 56 may be used to read and/or print or otherwise encode ticket vouchers 60. The ticket vouchers 60 may be composed of paper or another printable or encodable material and may have one or more of the following informational items printed or encoded thereon: the casino name, the type of ticket voucher, a validation number, a bar code with control and/or security data, the date and time of issuance of the ticket voucher, redemption instructions and restrictions, a description of an award, and any other information that may be necessary or desirable. Different types of ticket vouchers 60 could be used, such as bonus ticket vouchers, cash-redemption ticket vouchers, casino chip ticket vouchers, extra game play ticket vouchers, merchandise ticket vouchers, restaurant ticket vouchers, show ticket vouchers, etc. The ticket vouchers 60 could be printed with an optically readable material such as ink, or data on the ticket vouchers 60 could be magnetically encoded. The ticket reader/printer 56 may be provided with the ability to both read and print ticket vouchers 60, or it may be provided with the ability to only read or only print or encode ticket vouchers 60. In the latter case, for example, some of the gaming units 20 may have ticket printers 56 that may be used to print ticket vouchers 60, which could then be used by a player in other gaming units 20 that have ticket readers 56.

If provided, the card reader 58 may include any type of card reading device, such as a magnetic card reader or an optical card reader, and may be used to read data from a card offered by a player, such as a credit card or a player tracking card. If provided for player tracking purposes, the card reader 58 may be used to read data from, and/or write data to, player tracking cards that are capable of storing data representing the identity of a player, the identity of a casino, the player's gaming habits, etc.

The gaming unit 20 may include one or more audio speakers 62, a coin payout tray 64, an input control panel 66, and a color video display unit 70 for displaying images relating to the game or games provided by the gaming unit 20. The audio speakers 62 may generate audio representing sounds such as the noise of spinning slot machine reels, a dealer's voice, music, announcements or any other audio related to a casino game. The input control panel 66 may be provided with a plurality of pushbuttons or touch-sensitive areas that may be pressed by a player to select games, make wagers, make gaming decisions, etc.

Figure 2A:
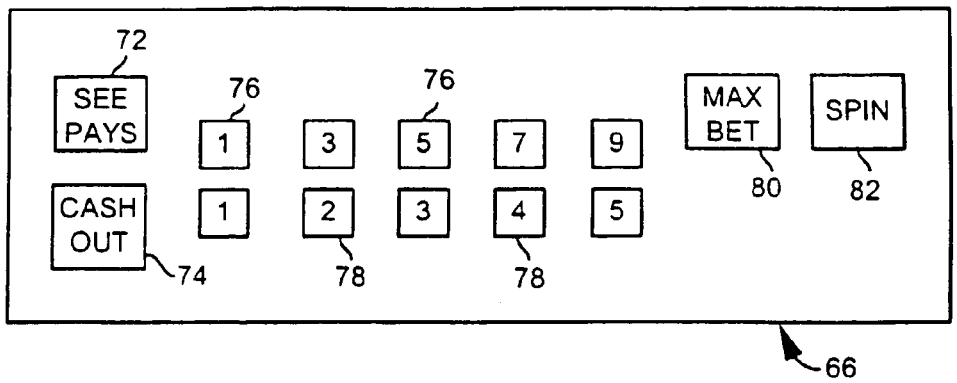
FIG. 2A illustrates an embodiment of a control panel for a gaming unit.

FIG. 2A illustrates one possible embodiment of the control panel 66, which may be used where the gaming unit 20 is a slot machine having a plurality of mechanical or "virtual" reels. Referring to FIG. 2A, the control panel 66 may include a "See Pays" button 72 that, when activated, causes the display unit 70 to generate one or more display screens showing the odds or payout information for the game or games provided by the gaming unit 20. As used herein, the term "button" is intended to encompass any device that allows a player to make an input, such as an input device that must be depressed to make an input selection or a display area that a player may simply touch. The control panel 66 may include a "Cash Out" button 74 that may be activated when a player decides to terminate play on the gaming unit 20, in which case the gaming unit 20 may return value to the player, such as by returning a number of coins to the player via the payout tray 64.

If the gaming unit 20 provides a slots game having a plurality of reels and a plurality of paylines which define winning combinations of reel symbols, the control panel 66 may be provided with a plurality of selection buttons 76, each of which allows the player to select a different number of paylines prior to spinning the reels. For example, five buttons 76 may be provided, each of which may allow a player to select one, three, five, seven or nine paylines.

If the gaming unit 20 provides a slots game having a plurality of reels, the control panel 66 may be provided with a plurality of selection buttons 78 each of which allows a player to specify a wager amount for each payline selected. For example, if the smallest wager accepted by the gaming unit 20 is a quarter ($0.25), the gaming unit 20 may be provided with five selection buttons 78, each of which may allow a player to select one, two, three, four or five quarters to wager for each payline selected. In that case, if a player were to activate the "5" button 76 (meaning that five paylines were to be played on the next spin of the reels) and then activate the "3" button 78 (meaning that three coins per payline were to be wagered), the total wager would be $3.75 (assuming the minimum bet was $0.25).

The control panel 66 may include a "Max Bet" button 80 to allow a player to make the maximum wager allowable for a game. In the above example, where up to nine paylines were provided and up to five quarters could be wagered for each payline selected, the maximum wager would be 45 quarters, or $11.25. The control panel 66 may include a spin button 82 to allow the player to initiate spinning of the reels of a slots game after a wager has been made.

In FIG. 2A, a rectangle is shown around the buttons 72, 74, 76, 78, 80, 82. It should be understood that the rectangle simply designates, for ease of reference, an area in which the buttons 72, 74, 76, 78, 80, 82 may be located. Consequently, the term "control panel" should not be construed to imply that a panel or plate separate from the housing 50 of the gaming unit 20 is required, and the term "control panel" may encompass a plurality or grouping of player activatable buttons.

Although one possible control panel 66 is described above, it should be understood that different buttons could be utilized in the control panel 66, and that the particular buttons used may depend on the game or games that could be played on the gaming unit 20. Although the control panel 66 is shown to be separate from the display unit 70, it should be understood that the control panel 66 could be generated by the display unit 70. In that case, each of the buttons of the control panel 66 could be a colored area generated by the display unit 70, and some type of mechanism may be associated with the display unit 70 to detect when each of the buttons was touched, such as a touch-sensitive screen.

Gaming Unit Electronics

Figure 3A:
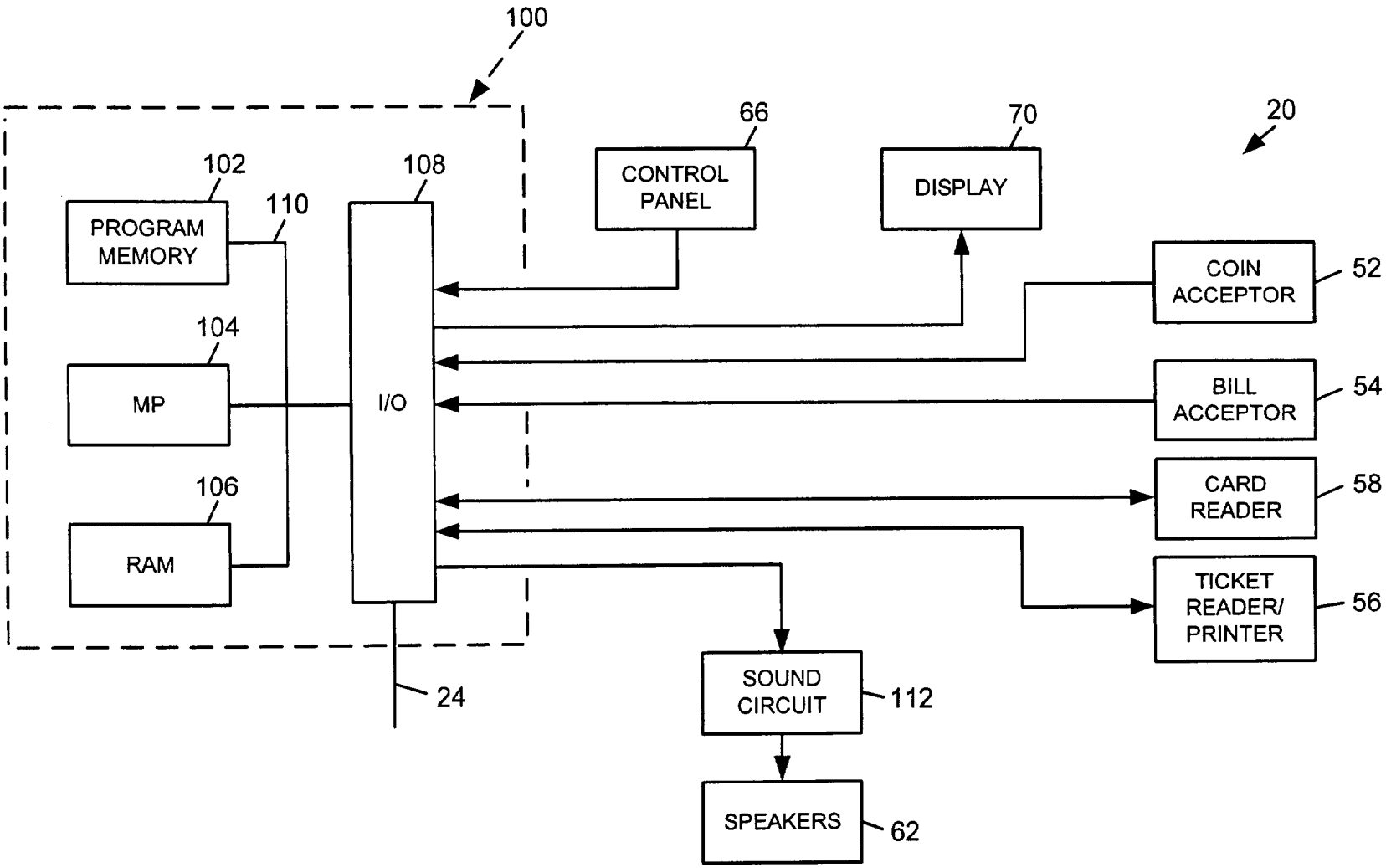
FIG. 3A is a block diagram of the electronic components of the gaming unit of FIG. 2.

FIG. 3A is a block diagram of a number of components that may be incorporated in the gaming unit 20. Referring to FIG. 3A, the gaming unit 20 may include a controller 100 that may comprise a program memory 102, a microcontroller or microprocessor (MP) 104, a random-access memory (RAM) 106 and an input/output (I/O) circuit 108, all of which may be interconnected via an address/data bus 110. It should be appreciated that although only one microprocessor 104 is shown, the controller 100 may include multiple microprocessors 104. Similarly, the memory of the controller 100 may include multiple RAMs 106 and multiple program memories 102. Although the I/O circuit 108 is shown as a single block, it should be appreciated that the I/O circuit 108 may include a number of different types of I/O circuits. The RAM(s) 104 and program memories 102 may be implemented as semiconductor memories, magnetically readable memories, and/or optically readable memories, for example.

Although the program memory 102 is shown in FIG. 3A as a read-only memory (ROM) 102, the program memory of the controller 100 may be a read/write or alterable memory, such as a hard disk. In the event a hard disk is used as a program memory, the address/data bus 110 shown schematically in FIG. 3A may comprise multiple address/data buses, which may be of different types, and there may be an I/O circuit disposed between the address/data buses.

FIG. 3A illustrates that the control panel 66, the coin acceptor 52, the bill acceptor 54, the card reader 58 and the ticket reader/printer 56 may be operatively coupled to the I/O circuit 108, each of those components being so coupled by either a unidirectional or bidirectional, single-line or multiple-line data link, which may depend on the design of the component that is used. The speaker(s) 62 may be operatively coupled to a sound circuit 112, that may comprise a voice- and sound-synthesis circuit or that may comprise a driver circuit. The sound-generating circuit 112 may be coupled to the I/O circuit 108.

As shown in FIG. 3A, the components 52, 54, 56, 58, 66, 112 may be connected to the I/O circuit 108 via a respective direct line or conductor. Different connection schemes could be used. For example, one or more of the components shown in FIG. 3A may be connected to the I/O circuit 108 via a common bus or other data link that is shared by a number of components. Furthermore, some of the components may be directly connected to the microprocessor 104 without passing through the I/O circuit 108.

Configuration Data Copying Routine

Figure 3B:
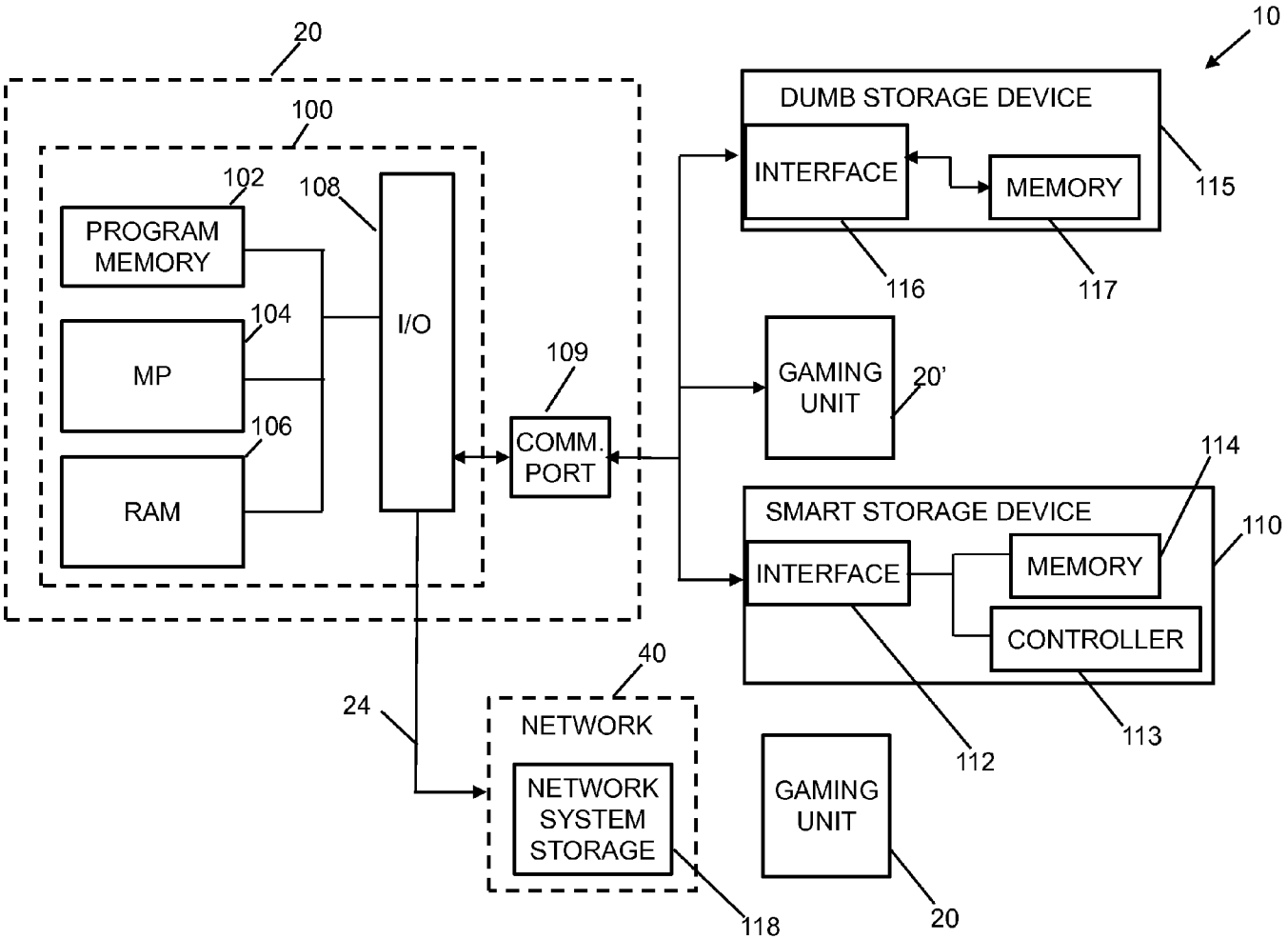
FIG. 3B is a block diagram of the electronic components of the gaming system of FIG. 1.

FIG. 3B is a block diagram of a number of components that may be incorporated in the casino gaming system 10 for copying configuration data between gaming units 20 or to and from the network 40. As shown in FIG. 3B, a gaming unit 20 is illustrated that may comprise a controller 100 similar to that discussed previously with respect to FIG. 3A. Furthermore, the controller 100 may include similar elements discussed with respect to FIG. 3A, which are also shown in FIG. 3B. The gaming unit 20 may also include a communication port 109 that may serve to interface the controller 100 with external storage devices or directly with other gaming units 20. This communication port 109 may be configured as an Ethernet interface, a serial interface, such as for a universal serial bus (USB), or any other known communications interface protocol.

For the purpose of copying configuration data contained within the program memory 102 or RAM 106 of the controller 100 to other gaming units 20 that may be part of the casino gaming system 10 or another gaming casino system, a smart storage device 110 may be connected via the communications port 109 by a data link 111. The data link 111 may comprise a universal serial bus (USB), an Ethernet connection or any other known type of data link, whether unidirectional or bidirectional, single-line or multiple-line. The smart storage device 110 may comprise, for example, a personal data assistant (PDA), a smart hard drive, an Ethernet enabled hard drive or any other device known in the art that may include a memory and a controller. As shown in FIG. 3B, the smart storage device 110 may contain an interface 112 that may allow communication over the data link 111 to the gaming unit 20. The interface 112 may be configured to allow access to a controller 113 and a memory 114 within the smart storage device 110. The controller 113 may be configured to control communications via the interface 112 and also write/read operations to the memory 114.

Another device that may be used to copy configuration data is a passive or dumb storage device 115. What is meant by the term "dumb" is that the storage device does not include a controller, processor or some logic that is capable of initiating communication to a device to which it is connected, the device writing to and reading from the dumb storage device. That is, the storage device may passively have data written thereto or read therefrom by another "intelligent" device. As illustrated in FIG. 3B, the dumb storage device may include an interface 116 allowing communication via the data link 111 to gaming unit 20. The interface 116 may allow access to a memory 117 contained within the dumb storage device 115 and may also contain a modicum of processing ability or logic to effect interfacing between the data link 111 and the memory 117 for read and write operations. The dumb storage device 115 may comprise devices such as "E-key" units or Ethernet enabled hard drives.

Yet another potential configuration for copying configuration data may be a direct connection between one gaming unit 20 and another gaming unit 20' via data link 111 as further illustrated in FIG. 3B. A potential configuration for connecting gaming units 20 and 20' may be a cross connection between respective communication ports 109 of the gaming units. Such cross connection involves connecting a transmit port within the communication port 109 of one gaming unit 20 to a receive port within the communication port 109 of the other gaming unit and a corresponding connection between the transmit port of the other gaming unit and the receive port of the source gaming machine. Hence, the two gaming units 20 may readily communicate and read and write configuration data to each other.

Still another configuration may include using the data link 24 as previously described in FIG. 3A, which may connect the gaming unit 20 to the network 40 in order to copy gaming machine settings, i.e., the configuration data. In this case, the network 40 may include a network system storage 118 used for reading and writing configurations to and from different gaming units 20. Thus, configuration data may be uploaded from a gaming unit 20 to the network system storage 118 within the network 40 and this data may, in turn, be downloaded to other gaming units 20 connected to the network 40 via the data links 24.

Figure 3C:
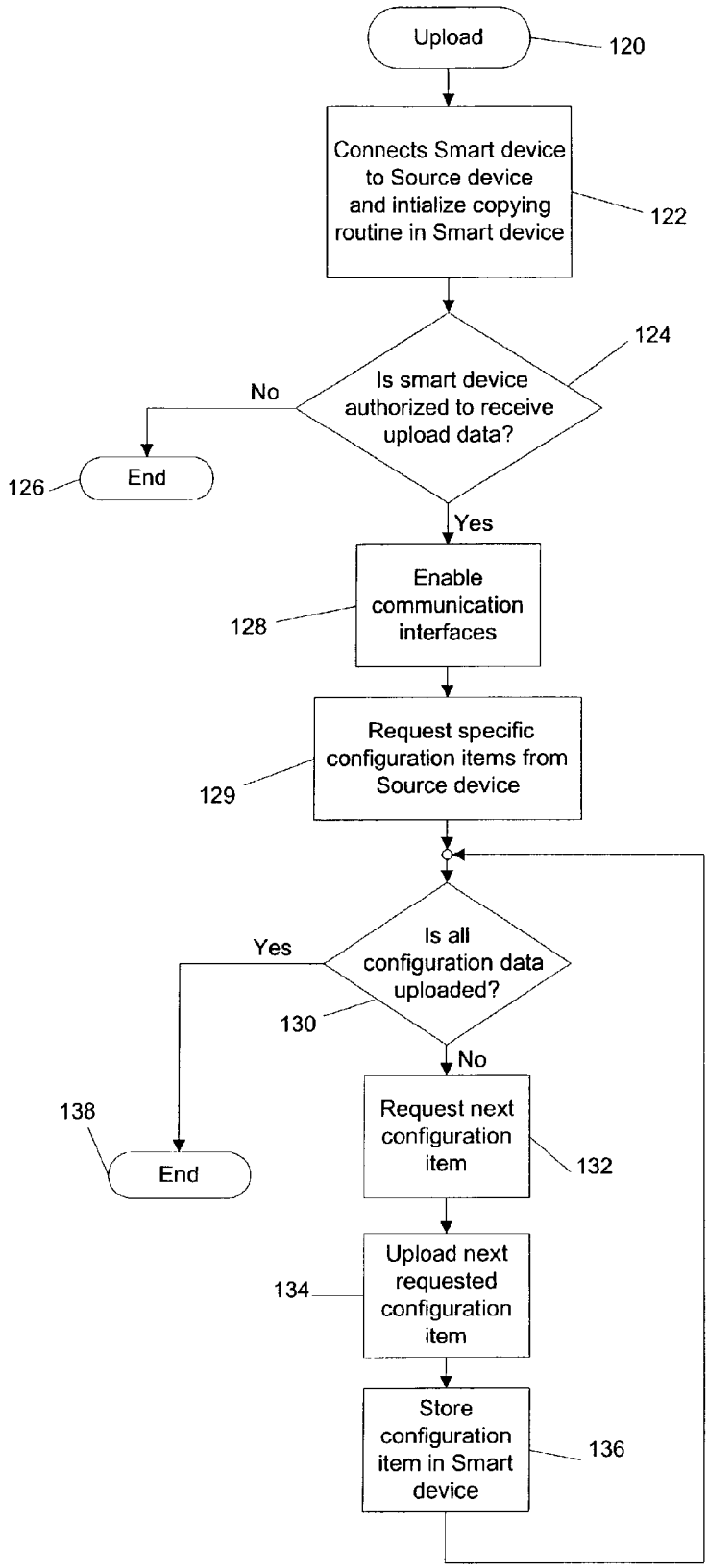
FIG. 3C is a flow chart of an embodiment of a copying routine that may be performed during upload of configuration data from a gaming unit.

FIG. 3C illustrates a flow chart of a routine that may be utilized to upload data between a gaming unit 20 and an external storage device. For purposes of discussing FIG. 3C, external storage device comprise the smart storage device 110 or the network system storage 118 as illustrated in FIG. 3B. As shown, FIG. 3C may represent a upload routine that may be used to transfer configuration data from a source gaming unit 20 to a destination external storage for purposes of copying the configuration data or simply uploading the configuration data. This process may be further programmed to automatically execute when the external storage device is connected or in communication with the source gaming unit 20.

As illustrated, the copying routine may begin at block 120. Next, the external storage device, which may be a smart storage device 110 or the network storage 118, may be connected to a source device such as a gaming unit 20 and the copying routine may be initialized within the external device as shown in block 122. Alternatively or simultaneously, the routine may also be initialized within the controller 100 of the source gaming unit 20.

Next, a determination may be made as to whether the external device is authorized to receive uploaded configuration data as indicated in decision block 124. Determination of whether the external storage device is authorized to upload configuration data may be determined within the controller 100 of the source gaming unit 20. Such authorization or authentication may be accomplished by exchanging identification information from the destination external storage device to the controller 100 of the source gaming unit 20, which may check the identification with stored authorized destination devices. In the case of uploading to the network systems storage 118, this authorization may also include checking within the network 40 whether a particular gaming unit 20 is authorized to upload data or determining whether other gaming units 20 connected to the network 40 are authorized to receive configuration data from the particular source gaming unit 20.

If, at block 124, determination can be made that the destination device is not authorized to upload configuration data, the procedure may terminate as indicated at block 126. On the other hand, if authorization can be found at block 124, the flow may proceed to block 128 wherein communication interfaces of the respective source and destination devices may be enabled. These communication interfaces may be of a Ethernet protocol, a serial bus, a local area network, a wide area network or the internet, as examples. The process of enabling the communication interfaces may also include handshaking between the destination and source devices that may ensure communication synchronization.

Once communication has been established, configuration items may be requested by the destination device that is uploading the configuration items. Specific configuration items may be requested or all of the configuration items of a particular gaming unit 20 may also be requested by the destination device as shown in block 129. Uploading of the requested configuration data may then be initiated. Periodically, the destination device may be queried as to whether all the configuration data has been uploaded as indicated in decision block 130. If the configuration data has not been completely uploaded, flow may proceed to block 132 where a next configuration item may be requested. The requested configuration item may then be uploaded from the source to the destination device as illustrated in block 134. Next, the uploaded configuration items may then be stored in the external device, such as in the memory 114 of the smart storage device 110 as shown in FIG. 3B or in the network system storage 118 of the network 40, as examples. The flow may then proceed back to decision block 130 to further query whether all the configuration data has been uploaded. When all of the configuration data is uploaded as may be determined at decision block 130, the routine may then terminate as indicated by block 138.

It is noted that since the smart storage device 110, in particular, may include a controller 113, processes such as checking authorization, monitoring the status of uploaded configuration data or initiation of communication in the above-described routine may be performed by the smart storage device 110. However, as noted previously these functions may also be performed by the source gaming unit 20.

When configuration data has been stored in an external storage, such as a smart storage device 111 or a network system storage 112, this data may, in turn, be downloaded to a destination device such as a gaming unit 20. An example of a downloading routine that may be used in illustrated in FIG. 3D. As shown, the downloading routing may begin at a block 140. The smart device or network may be connected to the destination device and initialization of the download copy routine may be performed as indicated in block 142. Here, either a physical connection may be initiated, such as connecting a smart storage device 110 to a gaming unit 20 or preliminary steps may be taken within the network system storage 118 to initiate a download to a destination device. Furthermore, the initialization may take place either in the source or destination devices.

As shown in decision block 144, a determination may be made as to whether the destination device potentially receiving downloaded data is authorized. This determination may be performed within the source external storage device. Additionally, this determination may also be made within the destination gaming unit 20 or the destination gaming unit 20 may be called upon by the source external device to provide an identification or key code or some other code through signaling via the interfaces that may allow authentication or authorization. Further, as part of checking authorization, the source external device may also send a signal via the data link 111 or network data link 24, as examples, to test whether a destination gaming unit 20 targeted to receive configuration data is of a type authorized to receive the configuration data. The system may further be configured such that the destination gaming unit may then receive an authorization code to return to the source external unit presently downloading configuration data or to facilitate future downloads from external units.

If, at block 144, no authorization can be found, the routine may end as shown at block 146. Alternatively, if the destination device is authorized to download data, communication interfaces between the source and destination devices may be enabled as indicated at block 148. Next, the destination device may request specific configuration items to be downloaded from the source external storage device as indicated in block 149. Periodically, during downloading of the configuration data, a query made be made, as indicated in decision block 150, whether or not all the configuration data has been downloaded. If all of the configuration data has not been downloaded, a request for next configuration items may be made as indicated in block 151 and may subsequently then be downloaded from the source to the destination device as indicated in block 152. Next, these configuration items may be stored in the memory of the destination gaming unit 20, such as in the program memory 102, for example. Flow then may return back to block 150 to further query whether the configuration data has been completely downloaded. When the configuration data has been all downloaded as determined at block 150, the routine may be terminated as indicated as block 156.

Figure 3D:
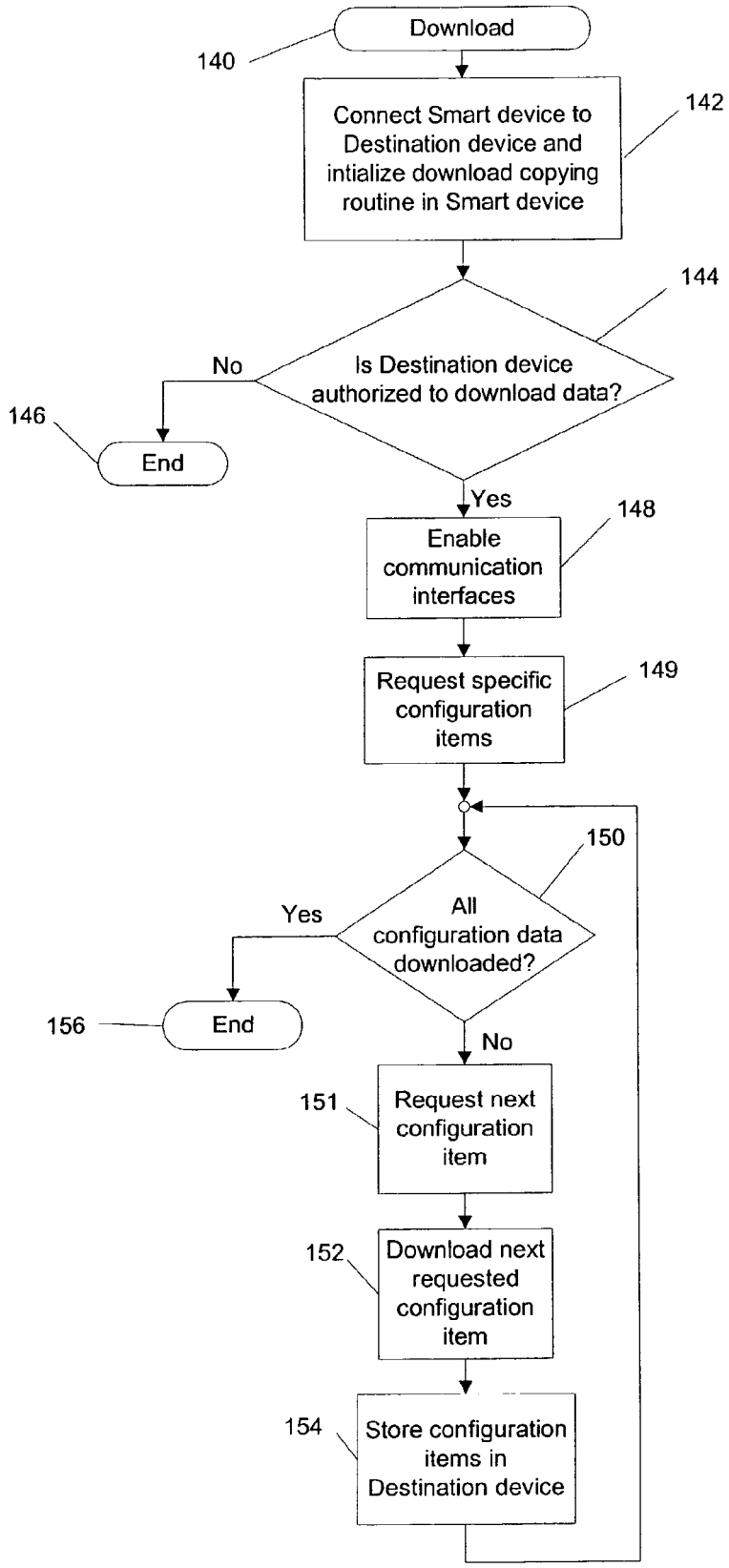
FIG. 3D is a flow chart of an embodiment of a copying routine that may be performed during download of configuration data to a gaming unit.

It is further noted that the copying routines illustrated in FIGS. 3C and 3D may be followed for copying of data from one gaming unit 20 to another gaming unit 20 via a cross-connection, for example. Different, however, from the routine of FIG. and 3D is that direct connection between two gaming units 20 may not need to utilize the procedure of re-connecting the gaming units 20 for the downloading routine. That is, the connection between two gaming units 20 may be made by first ensuring authorization and enabling communication between the units 20, but the configuration data may then be directly transferred from one gaming unit 20 to another gaming unit 20 such that uploading and downloading of the configuration data may be performed in a singular or unitary process or tansaction.

As noted previously, with respect to FIG. 3B, a dumb storage device 115 may further be utilized for copying configuration data between gaming units 20. Examples of dumb devices that may be used include E-key or Ethernet enabled hard drives. A feature of such dumb storage devices may be that the storage device does not include a controller or associated logic that manages communication in scheduling of uploading and downloading of information to a memory 117 within the dumb storage device 115. However, a modicum of processing information may be contained within the storage device to facilitate communication with a device external to the dumb storage device that writes to and reads from the dumb storage device.

Figure 3E:
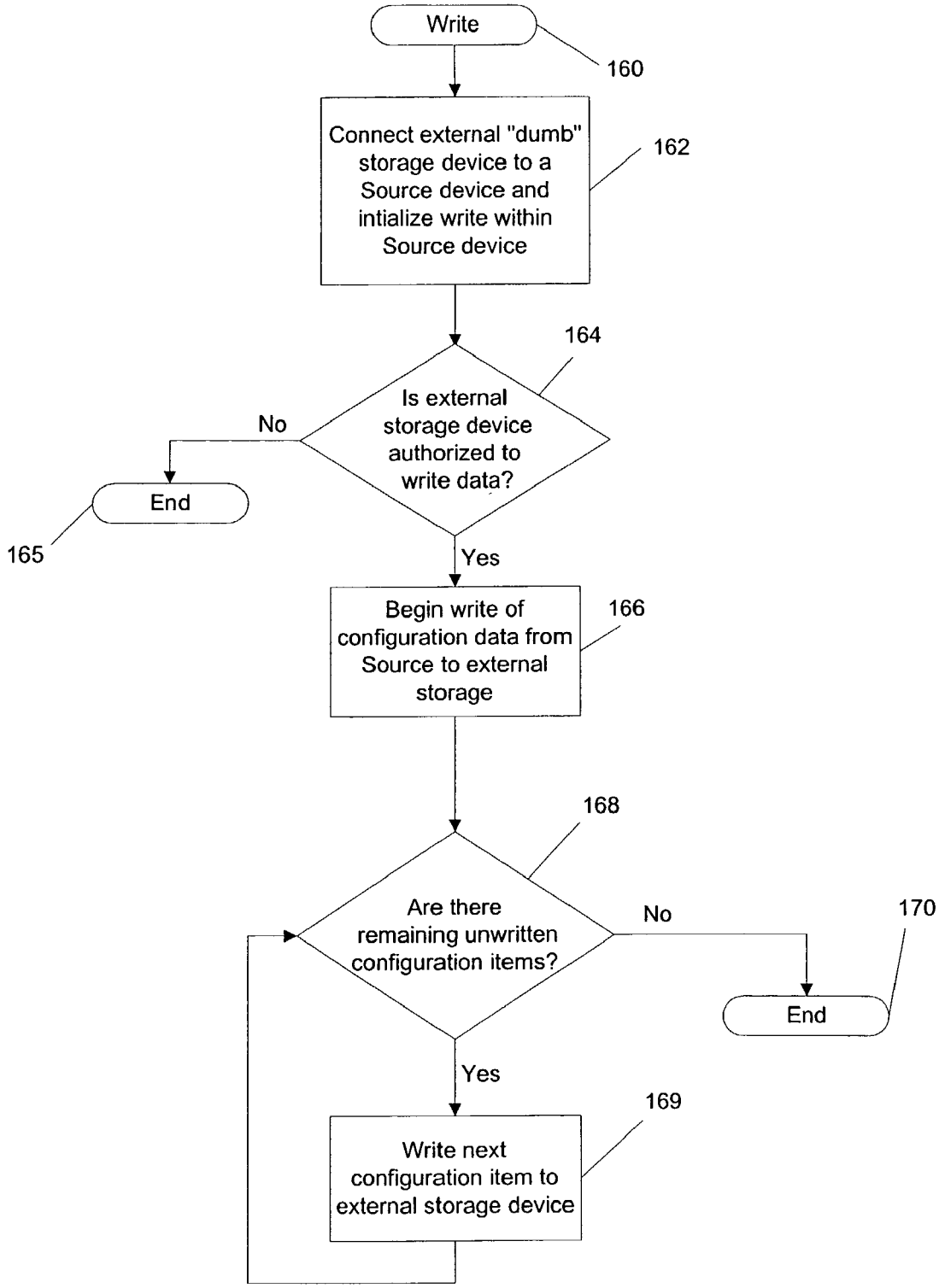
FIG. 3E is a flow chart of an embodiment of a copying routine that may be performed during a write operation from the gaming unit.

A write routine that may be utilized with the usage of a dumb storage device such as dumb storage device 110 as shown in FIG. 3B, is illustrated in FIG. 3E. The routine may start as shown at block 160 to initiate writing of configuration data from a source gaming unit 20 to a destination dumb storage device 115. The external dumb storage device 115 may be connected to the source gaming unit 20 and initialization of the write operation may be performed within the source gaming unit 20. A potential implementation of this process shown in block 162 may comprise detection by the controller 100 of the gaming unit 20 that a device has been connected to the communication port 109 via a data link 118. Furthermore, a predetermined protocol or configuration of the connection may be prescribed such that the controller 100 may recognize that a dumb storage device 115 has been connected thereto. Moreover, the controller 100 may be further configured to then initialize a write routine such as that illustrated in FIG. 3E when such connection is sensed.

The dumb storage device 115 may further include a identification or some other means of communicating a particular signature or identification to the controller 100 of the source gaming unit 20. Hence, the controller 100 may utilize such identification information to determine whether the dumb storage device 115 is authorized to receive written configuration data as illustrated in block 164. If the external dumb storage device 115 is not authorized, the routine may terminate as indicated by block 165. Alternatively, if the dumb storage device 115 is authorized to receive written configuration data, the source gaming unit 20 may then begin writing configuration data from its internal memory to the memory 117 of the dumb storage device via the I/O interface 108, the communication port 109, data link 111 and interface 116 as indicated at block 166 in FIG. 3E. Determination of which particular configuration data is to be written may be predetermined and stored in the program memory 102 of the controller 100. Alternatively, an indication may be sent from the interface 116 of the dumb storage device 115, wherein the interface 116 may have a modicum of processing ability in order to relay intelligent information to the controller 100 of the gaming unit 20 to indicate which configuration data should be written to the dumb storage device 115.

Next, the write routine may include a determination as to whether remaining unwritten configuration data is extant as indicated in decision block 168. If further unwritten configuration items might remain, the routine may then write a next configuration item to the external dumb storage device as indicated in block 169. When no remaining unwritten configuration data might be present, the routine may terminate as indicated in block 170.

Figure 3F:
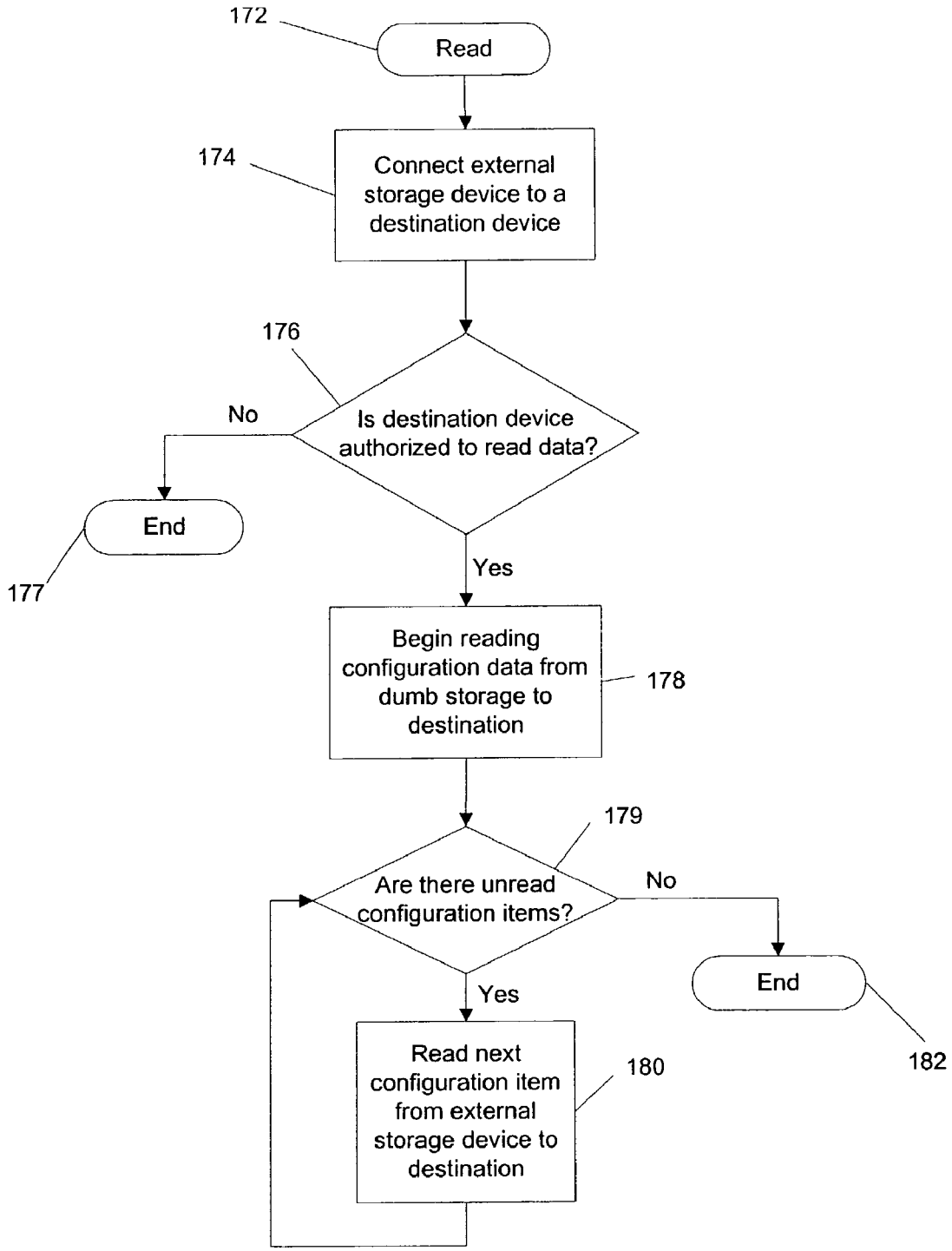
FIG. 3F is a flow chart of an embodiment of a copying routine that may be performed during a read operation to read configuration to a gaming unit.

Once configuration data has been written to a memory 117 of a dumb storage device 115, the dumb storage device 115 may, in turn, be connected to another gaming unit 20 in order to allow the other gaming unit 20 to read the configuration data that has been written therein. An example of a read routine that may be utilized is illustrated in FIG. 3F. As shown, the read routine may begin at block 172. The external dumb storage device 115, acting as a source of configuration data, may then be connected to a destination gaming unit 20 as indicated in block 174.

As noted previously with respect to the write routine described in FIG. 3E, the system may be configured such that when the dumb storage device 115 is connected to a gaming unit 20, the gaming unit 20 may be able to recognize that a dumb storage device 115 has been connected through utilization of a predetermined connection configuration or a identification information presented by the interface 116 of the dumb storage device 115. In the case of the read routine illustrated in FIG. 3F, the destination gaming unit 20 may be configured such that an operation logic within the program memory 102 of the controller 100 may be configured to only read from storage devices which it has been predetermined to have access. Thus, for example, an employee of a casino operator having a particular dumb storage device 115 may be denied or precluded from downloading data from a dumb storage device 115 to an unauthorized gaming unit 20. Hence, the read routine may include determining whether the destination gaming unit 20 is authorized to read the configuration data stored within the memory 117 of a dumb storage device 115 as illustrated in decision block 176. If the destination gaming unit 20 is not authorized, the read routine may end as indicated by block 177. Alternatively, if the destination source device 20 is authorized to read configuration data from the dumb storage device 115, initiation of the reading of the configuration data may begin as indicated in block 178.

Next, the destination gaming unit 20 may query whether there are remaining unread configuration data items within the memory 117 of the dumb storage device 115. If unread configuration items remain, the routine may continue reading the next configuration item from the memory of the dumb storage device 115 as indicated in block 180. When no more remaining unread configuration items might remain as determined at decision block 179, the read routine may terminate as indicated at block 182.

It is noted that the procedures for authorization of downloading and uploading information or writing and reading configuration data may utilize various methods of authorization such as transmitting key codes or other such information to permit access from one device to another.

It is further noted that the configuration data may comprise particular volume settings that are desired for particular periods and give audible indications for the various games that the gaming unit 20 may present. Further configuration data may comprise display options that are presented to a user over the display unit 70. Even further configuration data may comprise options for promotional credits and how and when, credits are accepted and awarded. Yet another example of configuration data may comprise the settings for various value denominations that are accepted by a particular gaming unit 20. It is noted that the above enumerated types of configuration data are merely exemplary and are not limited to just these examples.

Overall Operation of Gaming Units

One manner in which one or more of the gaming units 20 (and one or more of the gaming units 30) may operate is described below in connection with a number of flowcharts which represent a number of portions or routines of one or more computer programs, which may be stored in one or more of the memories of the controller 100. The computer program(s) or portions thereof may be stored remotely, outside of the gaming unit 20, and may control the operation of the gaming unit 20 from a remote location. Such remote control may be facilitated with the use of a wireless connection, or by an Internet interface that connects the gaming unit 20 with a remote computer (such as one of the network computers 22, 32) having a memory in which the computer program portions are stored. The computer program portions may be written in any high level language such as C, C+, C++ or the like or any low-level, assembly or machine language. By storing the computer program portions therein, various portions of the memories 102, 106 are physically and/or structurally configured in accordance with computer program instructions.

Figure 4:
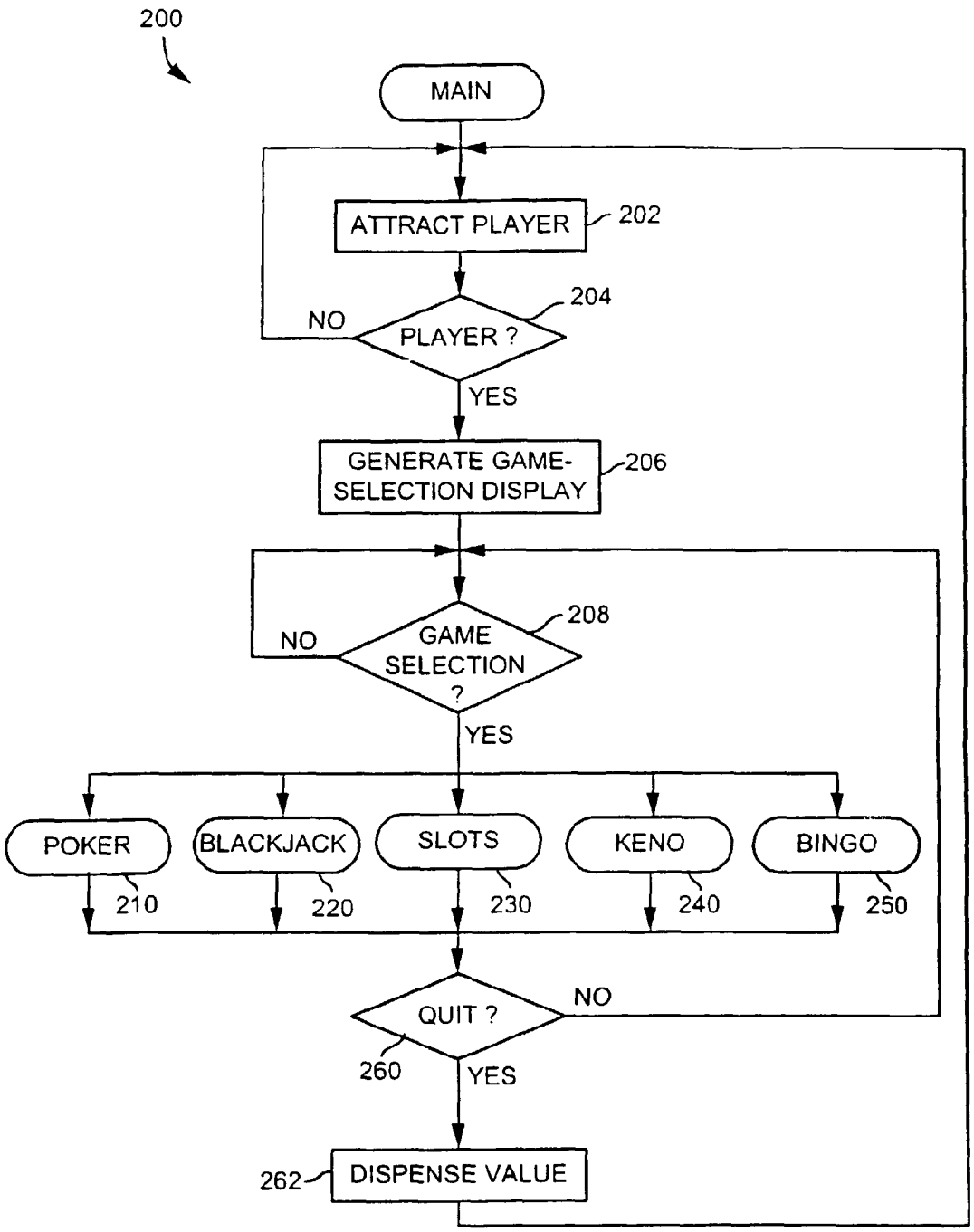
FIG. 4 is a flowchart of an embodiment of a main routine that may be performed during operation of one or more of the gaming units.

FIG. 4 is a flowchart of a main operating routine 200 that may be stored in the memory of the controller 100. Referring to FIG. 4, the main routine 200 may begin operation at block 202 during which an attraction sequence may be performed in an attempt to induce a potential player in a casino to play the gaming unit 20. The attraction sequence may be performed by displaying one or more video images on the display unit 70 and/or causing one or more sound segments, such as voice or music, to be generated via the speakers 62. The attraction sequence may include a scrolling list of games that may be played on the gaming unit 20 and/or video images of various games being played, such as video poker, video blackjack, video slots, video keno, video bingo, etc.

During performance of the attraction sequence, if a potential player makes any input to the gaming unit 20 as determined at block 204, the attraction sequence may be terminated and a game-selection display may be generated on the display unit 70 at block 206 to allow the player to select a game available on the gaming unit 20. The gaming unit 20 may detect an input at block 204 in various ways. For example, the gaming unit 20 could detect if the player presses any button on the gaming unit 20; the gaming unit 20 could determine if the player deposited one or more coins into the gaming unit 20; the gaming unit 20 could determine if player deposited paper currency into the gaming unit; etc.

The game-selection display generated at block 206 may include, for example, a list of video games that may be played on the gaming unit 20 and/or a visual message to prompt the player to deposit value into the gaming unit 20 While the game-selection display is generated, the gaming unit 20 may wait for the player to make a game selection. Upon selection of one of the games by the player as determined at block 208, the controller 100 may cause one of a number of game routines to be performed to allow the selected game to be played. For example, the game routines could include a video poker routine 210, a video blackjack routine 220, a slots routine 230, a video keno routine 240, and a video bingo routine 250. At block 208, if no game selection is made within a given period of time, the operation may branch back to block 202.

After one of the routines 210, 220, 230, 240, 250 has been performed to allow the player to play one of the games, block 260 may be utilized to determine whether the player wishes to terminate play on the gaming unit 20 or to select another game. If the player wishes to stop playing the gaming unit 20, which wish may be expressed, for example, by selecting a "Cash Out" button, the controller 100 may dispense value to the player at block 262 based on the outcome of the game(s) played by the player. The operation may then return to block 202. If the player did not wish to quit as determined at block 260, the routine may return to block 208 where the game-selection display may again be generated to allow the player to select another game.

It should be noted that although five gaming routines are shown in FIG. 4, a different number of routines could be included to allow play of a different number of games. The gaming unit 20 may also be programmed to allow play of different games.

Figure 5:
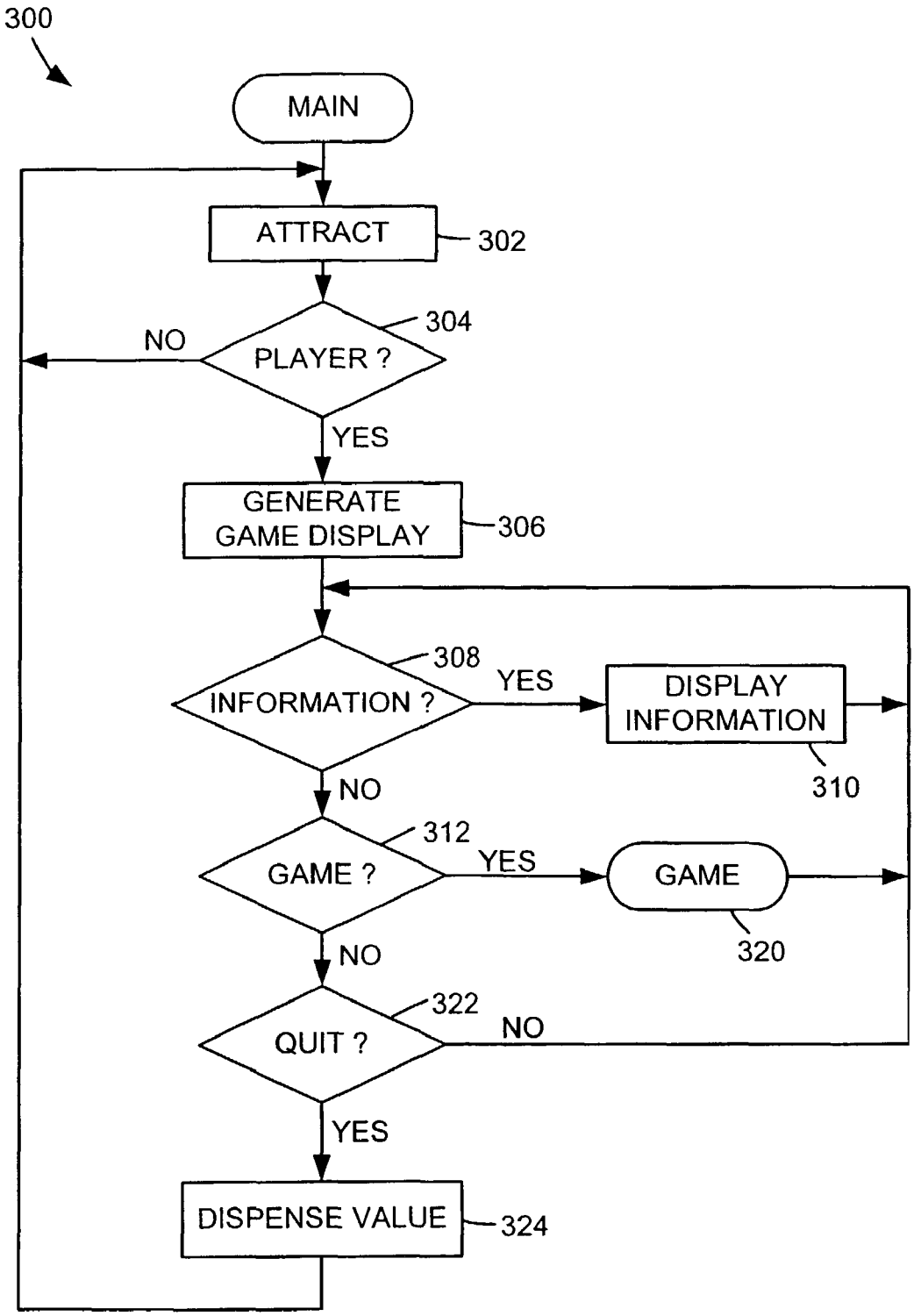
FIG. 5 is a flowchart of an alternative embodiment of a main routine that may be performed during operation of one or more of the gaming units.

FIG. 5 is a flowchart of an alternative main operating routine 300 that may be stored in the memory of the controller 100. The main routine 300 may be utilized for gaming units 20 that are designed to allow play of only a single game or single type of game. Referring to FIG. 5, the main routine 300 may begin operation at block 302 during which an attraction sequence may be performed in an attempt to induce a potential player in a casino to play the gaming unit 20. The attraction sequence may be performed by displaying one or more video images on the display unit 70 and/or causing one or more sound segments, such as voice or music, to be generated via the speakers 62.

During performance of the attraction sequence, if a potential player makes any input to the gaming unit 20 as determined at block 304, the attraction sequence may be terminated and a game display may be generated on the display unit 70 at block 306. The game display generated at block 306 may include, for example, an image of the casino game that may be played on the gaming unit 20 and/or a visual message to prompt the player to deposit value into the gaming unit 20. At block 308, the gaming unit 20 may determine if the player requested information concerning the game, in which case the requested information may be displayed at block 310. Block 312 may be used to determine if the player requested initiation of a game, in which case a game routine 320 may be performed. The game routine 320 could be any one of the game routines disclosed herein, such as one of the five game routines 210, 220, 230, 240, 250, or another game routine.

After the routine 320 has been performed to allow the player to play the game, block 322 may be utilized to determine whether the player wishes to terminate play on the gaming unit 20. If the player wishes to stop playing the gaming unit 20, which wish may be expressed, for example, by selecting a "Cash Out" button, the controller 100 may dispense value to the player at block 324 based on the outcome of the game(s) played by the player. The operation may then return to block 302. If the player did not wish to quit as determined at block 322, the operation may return to block 308.

Video Poker

Figure 6:
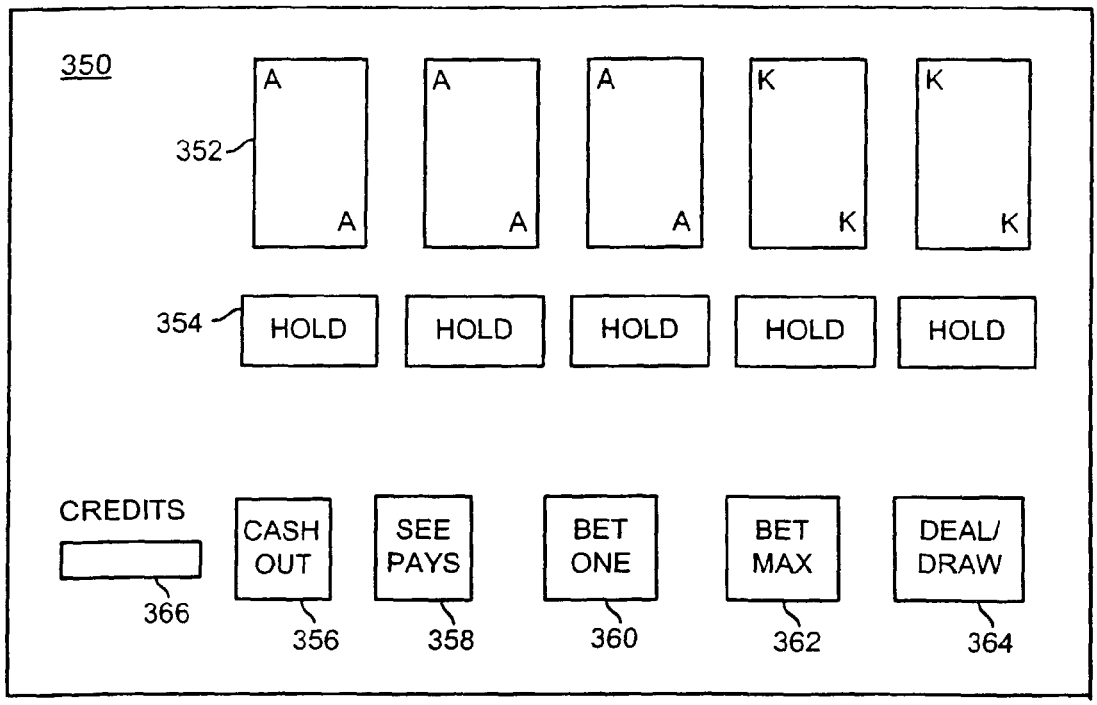
FIG. 6 is an illustration of an embodiment of a visual display that may be displayed during performance of the video poker routine of FIG. 8.

FIG. 6 is an exemplary display 350 that may be shown on the display unit 70 during performance of the video poker routine 210 shown schematically in FIG. 4. Referring to FIG. 6, the display 350 may include video images 352 of a plurality of playing cards representing the player's hand, such as five cards. To allow the player to control the play of the video poker game, a plurality of player-selectable buttons may be displayed. The buttons may include a "Hold" button 354 disposed directly below each of the playing card images 352, a "Cash Out" button 356, a "See Pays" button 358, a "Bet One Credit" button 360, a "Bet Max Credits" button 362, and a "Deal/Draw" button 364. The display 350 may also include an area 366 in which the number of remaining credits or value is displayed. If the display unit 70 is provided with a touch-sensitive screen, the buttons 354, 356, 358, 360, 362, 364 may form part of the video display 350. Alternatively, one or more of those buttons may be provided as part of a control panel that is provided separately from the display unit 70.

Figure 8:
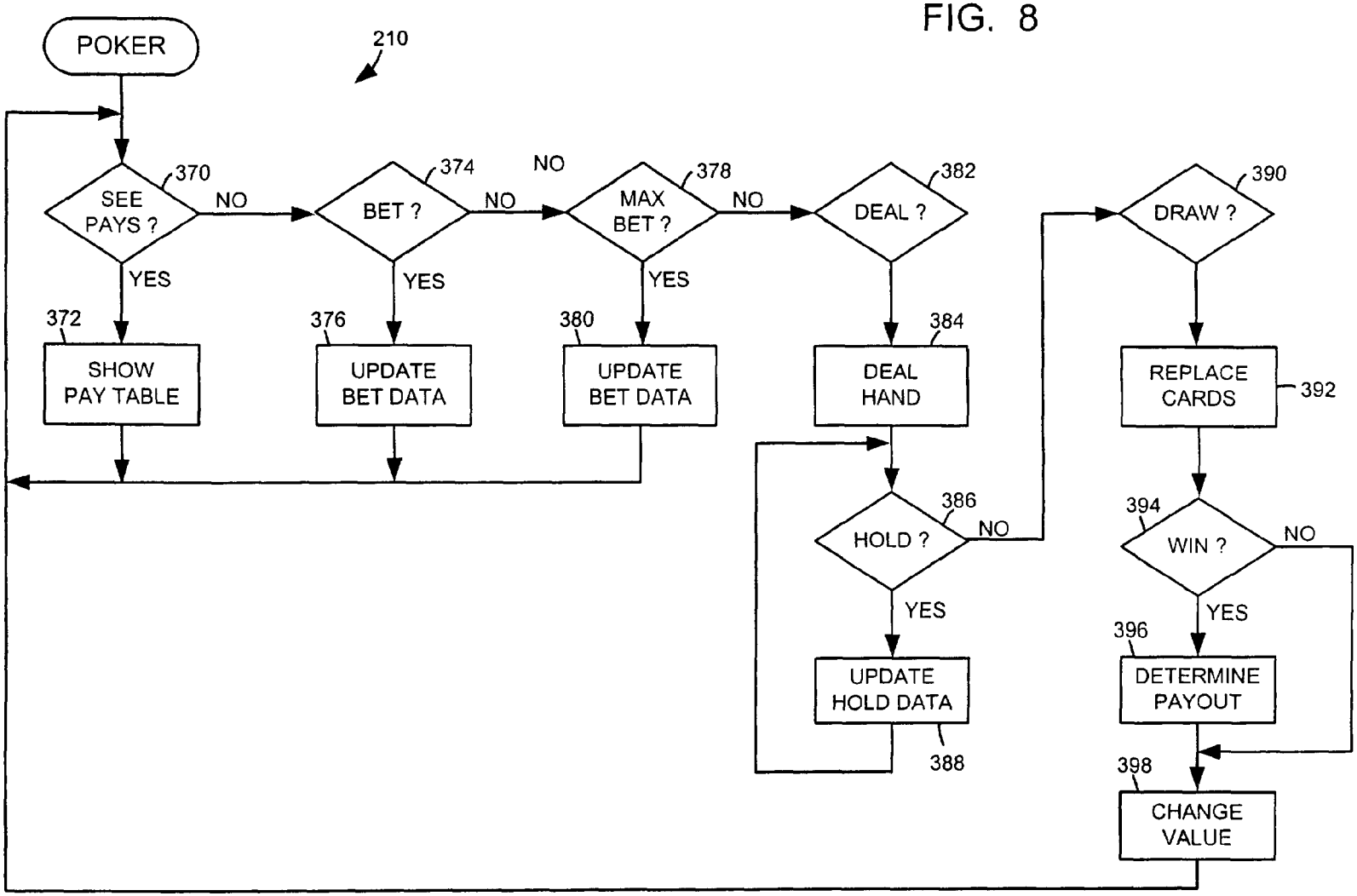
FIG. 8 is a flowchart of an embodiment of a video poker routine that may be performed by one or more of the gaming units.

FIG. 8 is a flowchart of the video poker routine 210 shown schematically in FIG. 4. Referring to FIG. 8, at block 370, the routine may determine whether the player has requested payout information, such as by activating the "See Pays" button 358, in which case at block 372 the routine may cause one or more pay tables to be displayed on the display unit 70. At block 374, the routine may determine whether the player has made a bet, such as by pressing the "Bet One Credit" button 360, in which case at block 376 bet data corresponding to the bet made by the player may be stored in the memory of the controller 100. At block 378, the routine may determine whether the player has pressed the "Bet Max Credits" button 362, in which case at block 380 bet data corresponding to the maximum allowable bet may be stored in the memory of the controller 100.

At block 382, the routine may determine if the player desires a new hand to be dealt, which may be determined by detecting if the "Deal/Draw" button 364 was activated after a wager was made. In that case, at block 384 a video poker hand may be "dealt" by causing the display unit 70 to generate the playing card images 352. After the hand is dealt, at block 386 the routine may determine if any of the "Hold" buttons 354 have been activated by the player, in which case data regarding which of the playing card images 352 are to be "held" may be stored in the controller 100 at block 388. If the "Deal/Draw" button 364 is activated again as determined at block 390, each of the playing card images 352 that was not "held" may be caused to disappear from the video display 350 and to be replaced by a new, randomly selected, playing card image 352 at block 392.

At block 394, the routine may determine whether the poker hand represented by the playing card images 352 currently displayed is a winner. That determination may be made by comparing data representing the currently displayed poker hand with data representing all possible winning hands, which may be stored in the memory of the controller 100. If there is a winning hand, a payout value corresponding to the winning hand may be determined at block 396. At block 398, the player's cumulative value or number of credits may be updated by subtracting the bet made by the player and adding, if the hand was a winner, the payout value determined at block 396. The cumulative value or number of credits may also be displayed in the display area 366 (FIG. 6).

Although the video poker routine 210 is described above in connection with a single poker hand of five cards, the routine 210 may be modified to allow other versions of poker to be played. For example, seven card poker may be played, or stud poker may be played. Alternatively, multiple poker hands may be simultaneously played. In that case, the game may begin by dealing a single poker hand, and the player may be allowed to hold certain cards. After deciding which cards to hold, the held cards may be duplicated in a plurality of different poker hands, with the remaining cards for each of those poker hands being randomly determined.

Video Blackjack

Figure 7:
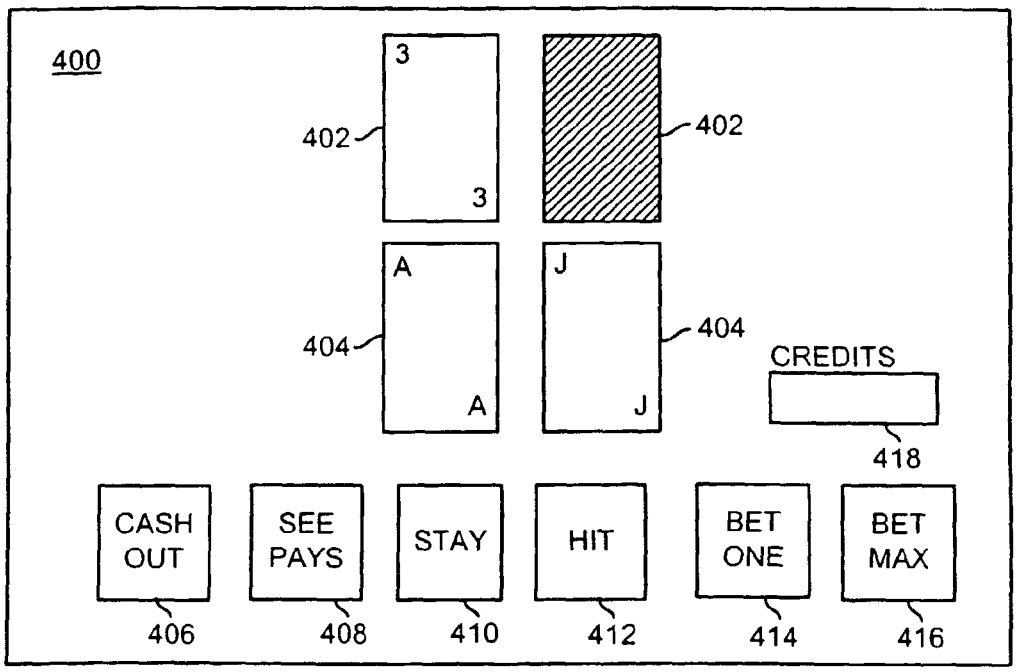
FIG. 7 is an illustration of an embodiment of a visual display that may be displayed during performance of the video blackjack routine of FIG. 9.

FIG. 7 is an exemplary display 400 that may be shown on the display unit 70 during performance of the video blackjack routine 220 shown schematically in FIG. 4. Referring to FIG. 7, the display 400 may include video images 402 of a pair of playing cards representing a dealer's hand, with one of the cards shown face up and the other card being shown face down, and video images 404 of a pair of playing cards representing a player's hand, with both the cards shown face up. The "dealer" may be the gaming unit 20.

To allow the player to control the play of the video blackjack game, a plurality of player-selectable buttons may be displayed. The buttons may include a "Cash Out" button 406, a "See Pays" button 408, a "Stay" button 410, a "Hit" button 412, a "Bet One Credit" button 414, and a "Bet Max Credits" button 416. The display 400 may also include an area 418 in which the number of remaining credits or value is displayed. If the display unit 70 is provided with a touch-sensitive screen, the buttons 406, 408, 410, 412, 414, 416 may form part of the video display 400. Alternatively, one or more of those buttons may be provided as part of a control panel that is provided separately from the display unit 70.

Figure 9:
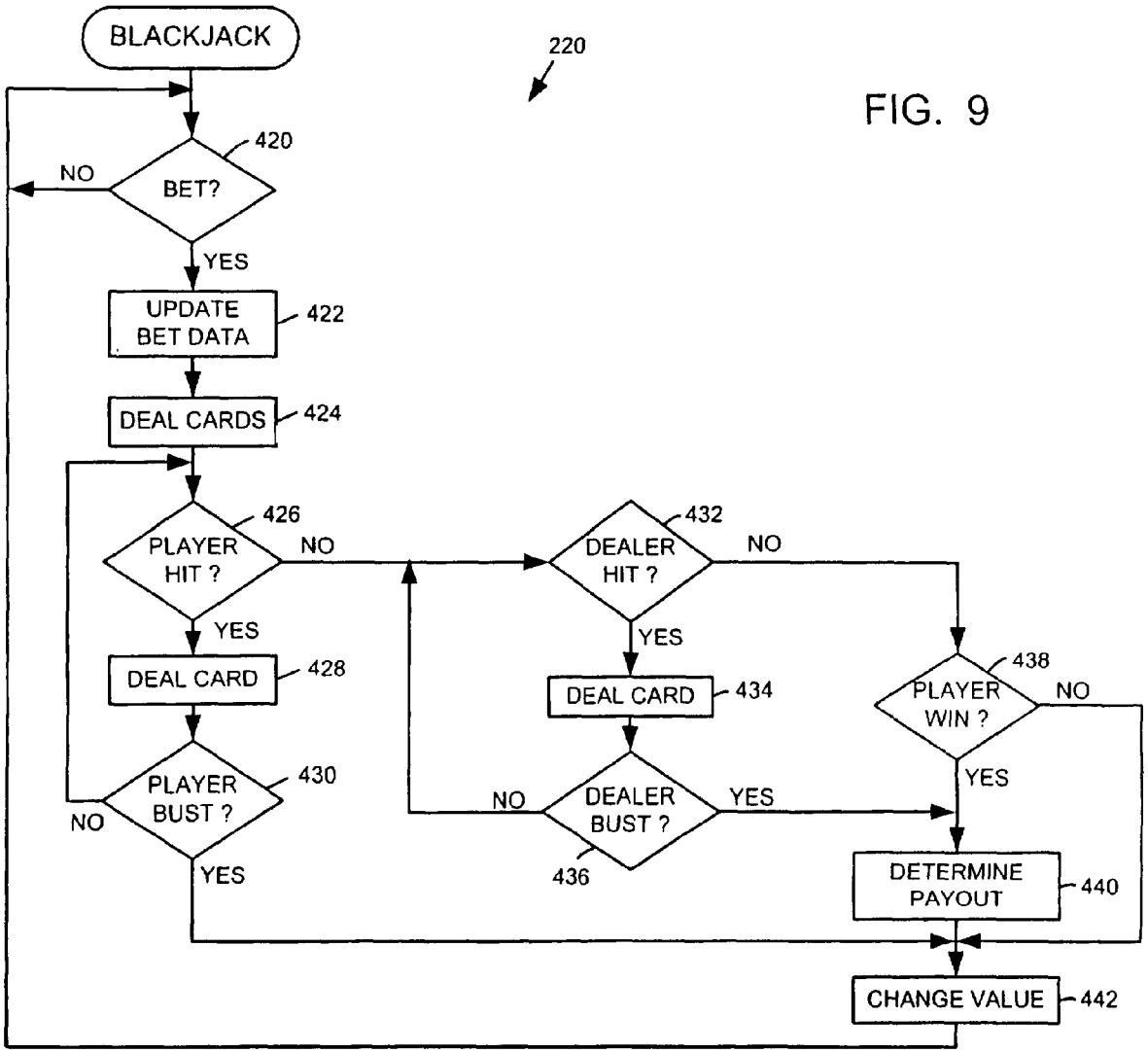
FIG. 9 is a flowchart of an embodiment of a video blackjack routine that may be performed by one or more of the gaming units.

FIG. 9 is a flowchart of the video blackjack routine 220 shown schematically in FIG. 4. Referring to FIG. 9, the video blackjack routine 220 may begin at block 420 where it may determine whether a bet has been made by the player. That may be determined, for example, by detecting the activation of either the "Bet One Credit" button 414 or the "Bet Max Credits" button 416. At block 422, bet data corresponding to the bet made at block 420 may be stored in the memory of the controller 100. At block 424, a dealer's hand and a player's hand may be "dealt" by making the playing card images 402, 404 appear on the display unit 70.

At block 426, the player may be allowed to be "hit," in which case at block 428 another card will be dealt to the player's hand by making another playing card image 404 appear in the display 400. If the player is hit, block 430 may determine if the player has "bust," or exceeded 21. If the player has not bust, blocks 426 and 428 may be performed again to allow the player to be hit again.

If the player decides not to hit, at block 432 the routine may determine whether the dealer should be hit. Whether the dealer hits may be determined in accordance with predetermined rules, such as the dealer always hit if the dealer's hand totals 15 or less. If the dealer hits, at block 434 the dealer's hand may be dealt another card by making another playing card image 402 appear in the display 400. At block 436 the routine may determine whether the dealer has bust. If the dealer has not bust, blocks 432, 434 may be performed again to allow the dealer to be hit again.

If the dealer does not hit, at block 436 the outcome of the blackjack game and a corresponding payout may be determined based on, for example, whether the player or the dealer has the higher hand that does not exceed 21. If the player has a winning hand, a payout value corresponding to the winning hand may be determined at block 440. At block 442, the player's cumulative value or number of credits may be updated by subtracting the bet made by the player and adding, if the player won, the payout value determined at block 440. The cumulative value or number of credits may also be displayed in the display area 418 (FIG. 7).

Slots

FIG. 10 is an exemplary display 450 that may be shown on the display unit 70 during performance of the slots routine 230 shown schematically in FIG. 4. Referring to FIG. 10, the display 450 may include video images 452 of a plurality of slot machine reels, each of the reels having a plurality of reel symbols 454 associated therewith. Although the display 450 shows five reel images 452, each of which may have three reel symbols 454 that are visible at a time, other reel configurations could be utilized.

To allow the player to control the play of the slots game, a plurality of player-selectable buttons may be displayed. The buttons may include a "Cash Out" button 456, a "See Pays" button 458, a plurality of payline-selection buttons 460 each of which allows the player to select a different number of paylines prior to "spinning" the reels, a plurality of bet-selection buttons 462 each of which allows a player to specify a wager amount for each payline selected, a "Spin" button 464, and a "Max Bet" button 466 to allow a player to make the maximum wager allowable.

Figure 12:
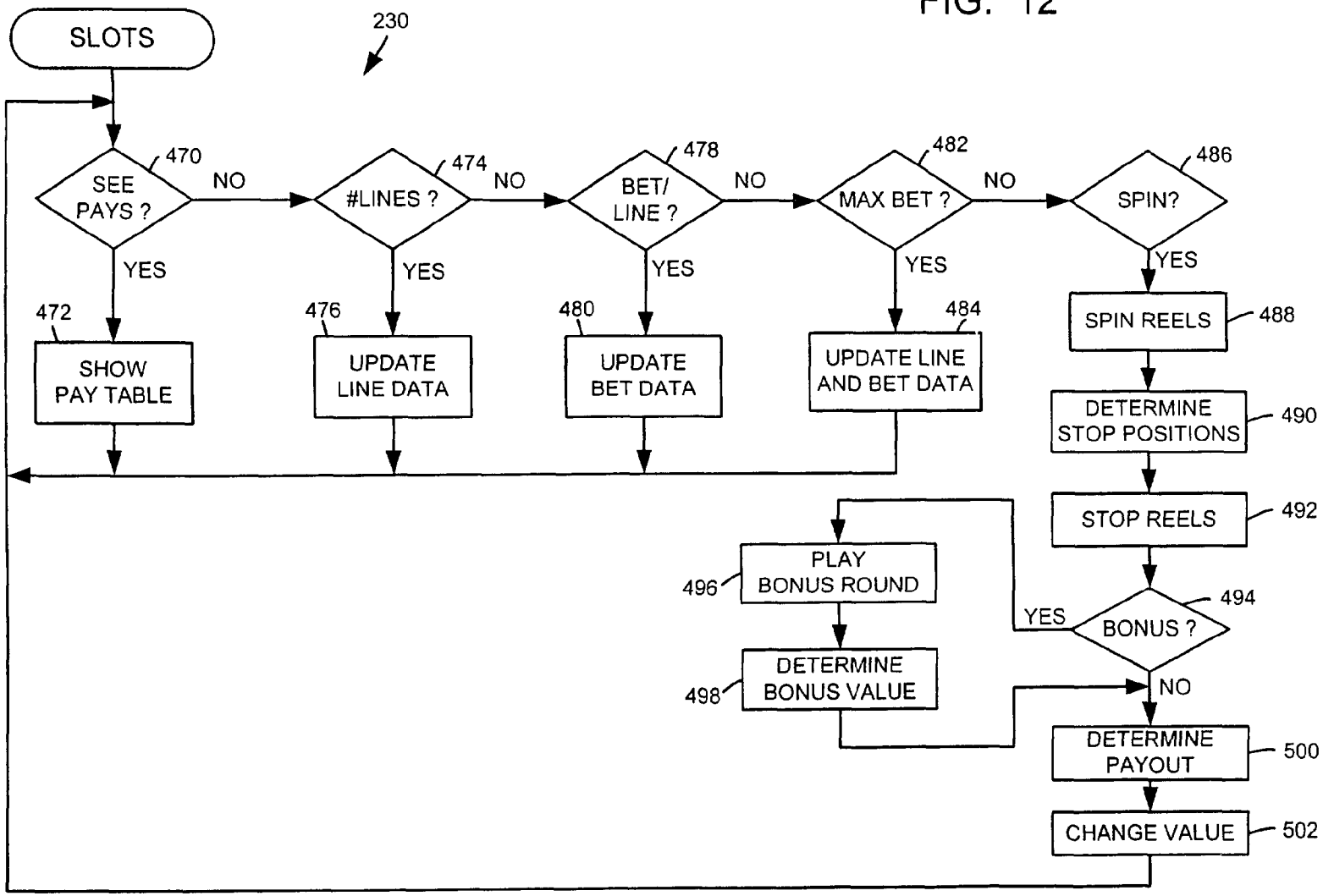
FIG. 12 is a flowchart of an embodiment of a slots routine that may be performed by one or more of the gaming units.

FIG. 12 is a flowchart of the slots routine 230 shown schematically in FIG. 10. Referring to FIG. 12, at block 470, the routine may determine whether the player has requested payout information, such as by activating the "See Pays" button 458, in which case at block 472 the routine may cause one or more pay tables to be displayed on the display unit 70. At block 474, the routine may determine whether the player has pressed one of the payline-selection buttons 460, in which case at block 476 data corresponding to the number of paylines selected by the player may be stored in the memory of the controller 100. At block 478, the routine may determine whether the player has pressed one of the bet-selection buttons 462, in which case at block 480 data corresponding to the amount bet per payline may be stored in the memory of the controller 100. At block 482, the routine may determine whether the player has pressed the "Max Bet" button 466, in which case at block 484 bet data (which may include both payline data and bet-per-payline data) corresponding to the maximum allowable bet may be stored in the memory of the controller 100.

If the "Spin" button 464 has been activated by the player as determined at block 486, at block 488 the routine may cause the slot machine reel images 452 to begin "spinning" so as to simulate the appearance of a plurality of spinning mechanical slot machine reels. At block 490, the routine may determine the positions at which the slot machine reel images will stop, or the particular symbol images 454 that will be displayed when the reel images 452 stop spinning. At block 492, the routine may stop the reel images 452 from spinning by displaying stationary reel images 452 and images of three symbols 454 for each stopped reel image 452. The virtual reels may be stopped from left to right, from the perspective of the player, or in any other manner or sequence.

The routine may provide for the possibility of a bonus game or round if certain conditions are met, such as the display in the stopped reel images 452 of a particular symbol 454. If there is such a bonus condition as determined at block 494, the routine may proceed to block 496 where a bonus round may be played. The bonus round may be a different game than slots, and many other types of bonus games could be provided. If the player wins the bonus round, or receives additional credits or points in the bonus round, a bonus value may be determined at block 498. A payout value corresponding to outcome of the slots game and/or the bonus round may be determined at block 500. At block 502, the player's cumulative value or number of credits may be updated by subtracting the bet made by the player and adding, if the slot game and/or bonus round was a winner, the payout value determined at block 500.

Although the above routine has been described as a virtual slot machine routine in which slot machine reels are represented as images on the display unit 70, actual slot machine reels that are capable of being spun may be utilized instead.

Video Keno

FIG. 11 is an exemplary display 520 that may be shown on the display unit 70 during performance of the video keno routine 240 shown schematically in FIG. 4. Referring to FIG. 11, the display 520 may include a video image 522 of a plurality of numbers that were selected by the player prior to the start of a keno game and a video image 524 of a plurality of numbers randomly selected during the keno game. The randomly selected numbers may be displayed in a grid pattern.

To allow the player to control the play of the keno game, a plurality of player-selectable buttons may be displayed. The buttons may include a "Cash Out" button 526, a "See Pays" button 528, a "Bet One Credit" button 530, a "Bet Max Credits" button 532, a "Select Ticket" button 534, a "Select Number" button 536, and a "Play" button 538. The display 520 may also include an area 540 in which the number of remaining credits or value is displayed. If the display unit 70 is provided with a touch-sensitive screen, the buttons may form part of the video display 520. Alternatively, one or more of those buttons may be provided as part of a control panel that is provided separately from the display unit 70.

Figure 13:
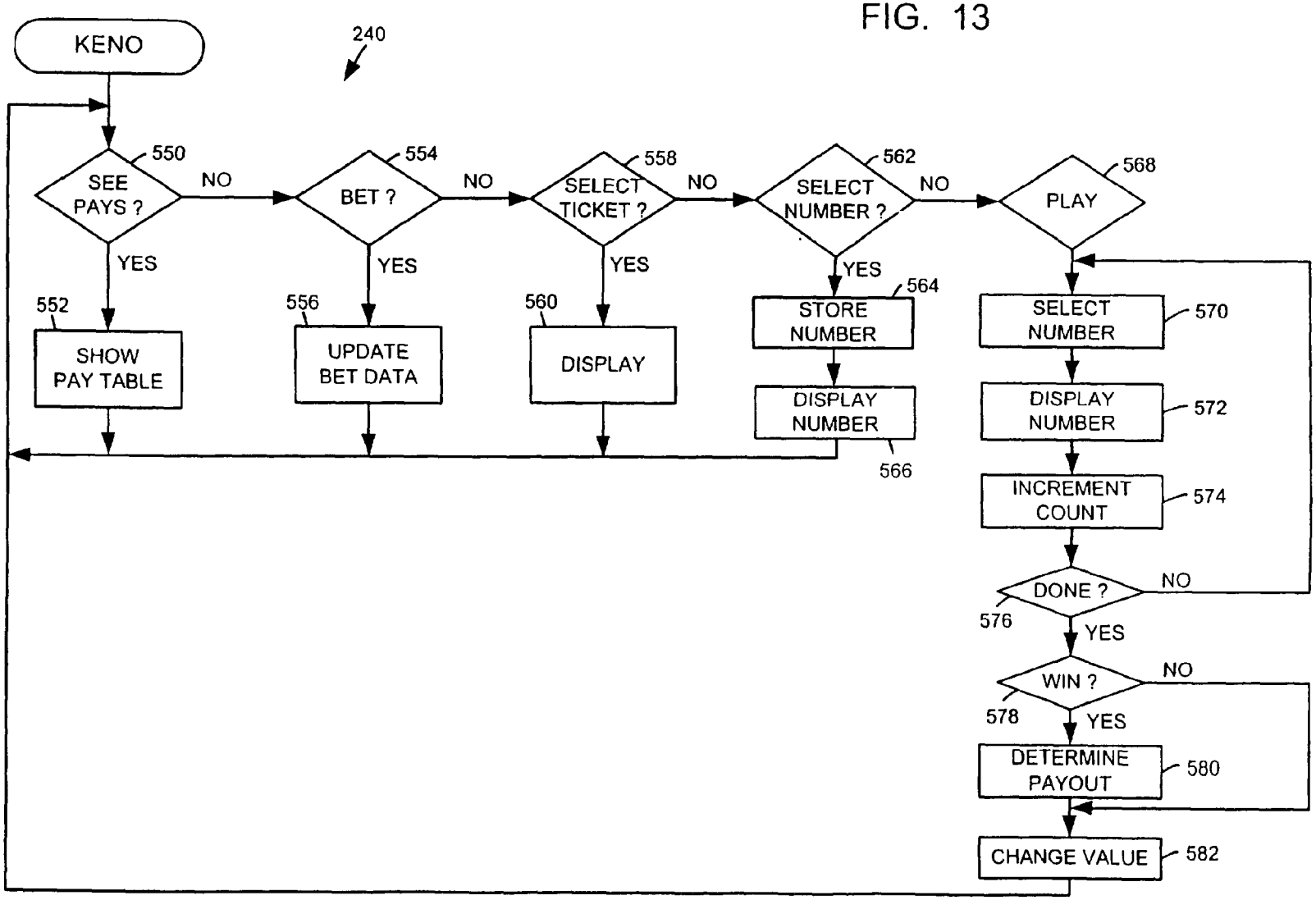
FIG. 13 is a flowchart of an embodiment of a video keno routine that may be performed by one or more of the gaming units.

FIG. 13 is a flowchart of the video keno routine 240 shown schematically in FIG. 4. The keno routine 240 may be utilized in connection with a single gaming unit 20 where a single player is playing a keno game, or the keno routine 240 may be utilized in connection with multiple gaming units 20 where multiple players are playing a single keno game. In the latter case, one or more of the acts described below may be performed either by the controller 100 in each gaming unit or by one of the network computer 22, 32 to which multiple gaming units 20 are operatively connected.

Referring to FIG. 13, at block 550, the routine may determine whether the player has requested payout information, such as by activating the "See Pays" button 528, in which case at block 552 the routine may cause one or more pay tables to be displayed on the display unit 70. At block 554, the routine may determine whether the player has made a bet, such as by having pressed the "Bet One Credit" button 530 or the "Bet Max Credits" button 532, in which case at block 556 bet data corresponding to the bet made by the player may be stored in the memory of the controller 100. After the player has made a wager, at block 558 the player may select a keno ticket, and at block 560 the ticket may be displayed on the display 520. At block 562, the player may select one or more game numbers, which may be within a range set by the casino. After being selected, the player's game numbers may be stored in the memory of the controller 100 at block 564 and may be included in the image 522 on the display 520 at block 566. After a certain amount of time, the keno game may be closed to additional players (where a number of players are playing a single keno game using multiple gambling units 20).

If play of the keno game is to begin as determined at block 568, at block 570 a game number within a range set by the casino may be randomly selected either by the controller 100 or a central computer operatively connected to the controller, such as one of the network computers 22, 32. At block 572, the randomly selected game number may be displayed on the display unit 70 and the display units 70 of other gaming units 20 (if any) which are involved in the same keno game. At block 574, the controller 100 (or the central computer noted above) may increment a count which keeps track of how many game numbers have been selected at block 570.

At block 576, the controller 100 (or one of the network computers 22, 32) may determine whether a maximum number of game numbers within the range have been randomly selected. If not, another game number may be randomly selected at block 570. If the maximum number of game numbers has been selected, at block 578 the controller 100 (or a central computer) may determine whether there are a sufficient number of matches between the game numbers selected by the player and the game numbers selected at block 570 to cause the player to win. The number of matches may depend on how many numbers the player selected and the particular keno rules being used.

If there are a sufficient number of matches, a payout may be determined at block 580 to compensate the player for winning the game. The payout may depend on the number of matches between the game numbers selected by the player and the game numbers randomly selected at block 570. At block 582, the player's cumulative value or number of credits may be updated by subtracting the bet made by the player and adding, if the keno game was won, the payout value determined at block 580. The cumulative value or number of credits may also be displayed in the display area 540 (FIG. 11).

Video Bingo

Figure 14:
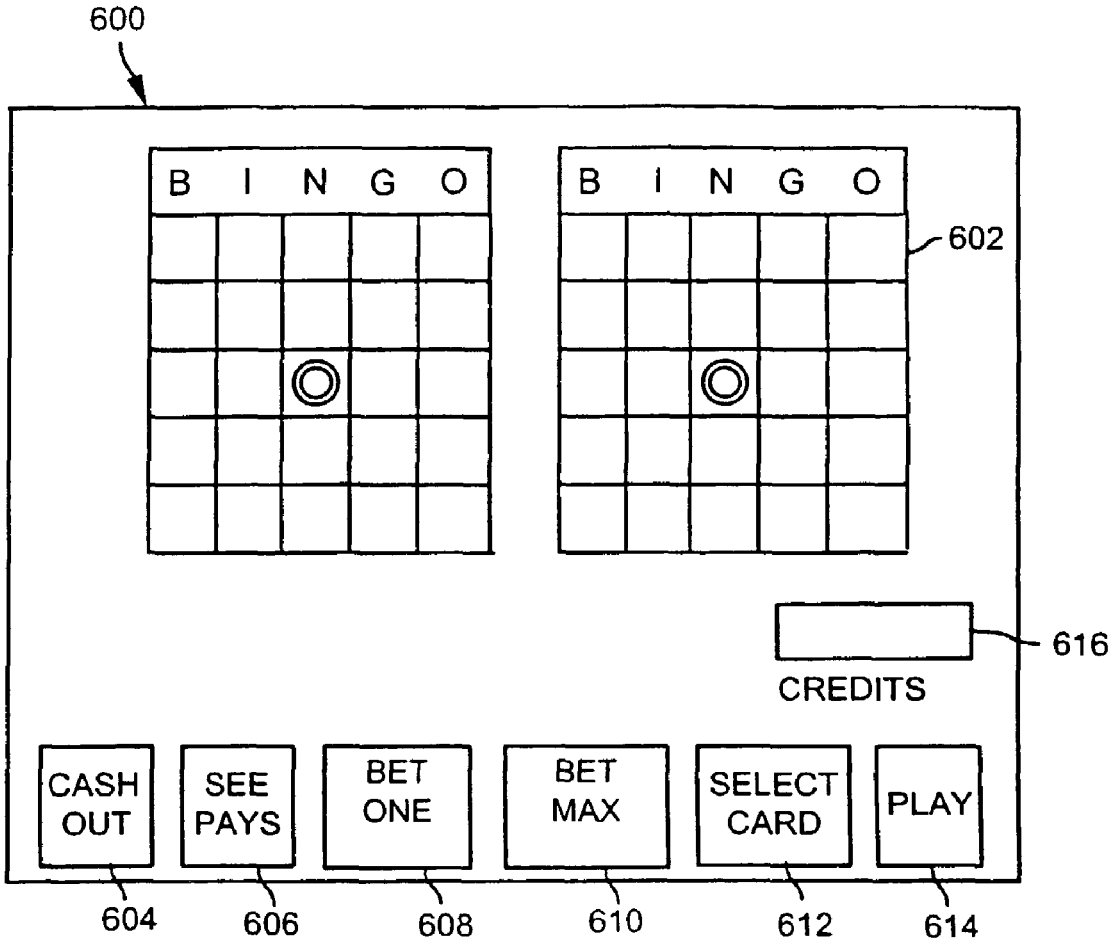
FIG. 14 is an illustration of an embodiment of a visual display that may be displayed during performance of the video bingo routine of FIG. 15.

FIG. 14 is an exemplary display 600 that may be shown on the display unit 70 during performance of the video bingo routine 250 shown schematically in FIG. 4. Referring to FIG. 14, the display 600 may include one or more video images 602 of a bingo card and images of the bingo numbers selected during the game. The bingo card images 602 may have a grid pattern.

To allow the player to control the play of the bingo game, a plurality of player-selectable buttons may be displayed. The buttons may include a "Cash Out" button 604, a "See Pays" button 606, a "Bet One Credit" button 608, a "Bet Max Credits" button 610, a "Select Card" button 612, and a "Play" button 614. The display 600 may also include an area 616 in which the number of remaining credits or value is displayed. If the display unit 70 is provided with a touch-sensitive screen, the buttons may form part of the video display 600. Alternatively, one or more of those buttons may be provided as part of a control panel that is provided separately from the display unit 70.

Figure 15:
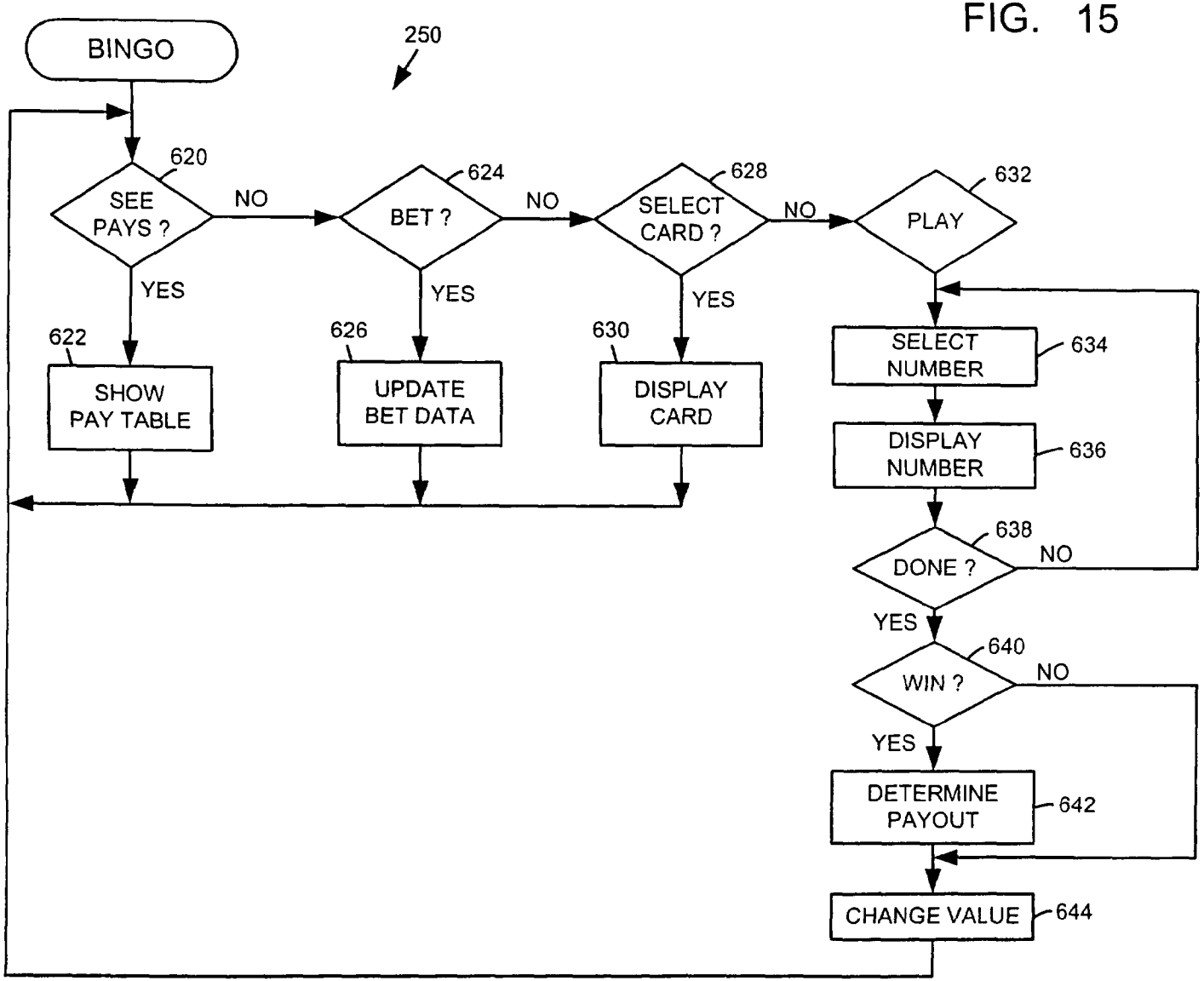
FIG. 15 is a flowchart of an embodiment of a video bingo routine that may be performed by one or more of the gaming units.

FIG. 15 is a flowchart of the video bingo routine 250 shown schematically in FIG. 4. The bingo routine 250 may be utilized in connection with a single gaming unit 20 where a single player is playing a bingo game, or the bingo routine 250 may be utilized in connection with multiple gaming units 20 where multiple players are playing a single bingo game. In the latter case, one or more of the acts described below may be performed either by the controller 100 in each gaming unit 20 or by one of the network computers 22, 32 to which multiple gaming units 20 are operatively connected.

Referring to FIG. 15, at block 620, the routine may determine whether the player has requested payout information, such as by activating the "See Pays" button 606, in which case at block 622 the routine may cause one or more pay tables to be displayed on the display unit 70. At block 624, the routine may determine whether the player has made a bet, such as by having pressed the "Bet One Credit" button 608 or the "Bet Max Credits" button 610, in which case at block 626 bet data corresponding to the bet made by the player may be stored in the memory of the controller 100.

After the player has made a wager, at block 628 the player may select a bingo card, which may be generated randomly. The player may select more than one bingo card, and there may be a maximum number of bingo cards that a player may select. After play is to commence as determined at block 632, at block 634 a bingo number may be randomly generated by the controller 100 or a central computer such as one of the network computers 22, 32. At block 636, the bingo number may be displayed on the display unit 70 and the display units 70 of any other gaming units 20 involved in the bingo game.

At block 638, the controller 100 (or a central computer) may determine whether any player has won the bingo game. If no player has won, another bingo number may be randomly selected at block 634. If any player has bingo as determined at block 638, the routine may determine at block 640 whether the player playing that gaming unit 20 was the winner. If so, at block 642 a payout for the player may be determined. The payout may depend on the number of random numbers that were drawn before there was a winner, the total number of winners (if there was more than one player), and the amount of money that was wagered on the game. At block 644, the player's cumulative value or number of credits may be updated by subtracting the bet made by the player and adding, if the bingo game was won, the payout value determined at block 642. The cumulative value or number of credits may also be displayed in the display area 616 (FIG. 14).

The invention claimed is:

1. A method for copying configuration data from a first gaming machine to a second gaming machine, comprising:

sensing the connection of an external device to said first gaming machine via an interface port;

automatically executing a copying routine to be performed at least within said first gaming machine upon sensing said connection of the external device;

determining by said automatically executed copy routine whether said external device is authorized to receive said configuration data from said first gaming machine when said external device is connected to said gaming machine;

copying at least a portion of said configuration data from said gaming machine to said external device if said external device is authorized to receive said configuration data;

connecting said external device to a second gaming machine via a second interface port;

determining by and within said external device whether said second gaming machine is authorized to receive said configuration data copied to said external device with authorization of said first gaming machine when said external device is connected to said second gaming device; and copying said configuration data from said external device to said second gaming machine only if said second gaming device is authorized to receive said configuration data.

2. A method as defined in claim 1, wherein said external device comprises a smart external memory and at least one of said second gaming machine and said smart external memory automatically initiate copying of said configuration data when said external device is interfaced with said second gaming machine.

3. A method as defined in claim 2, wherein said smart external memory comprises one of a personal data assistant and a personal computer.

4. A method as defined in claim 1, wherein said external device comprises one of an Ethernet enabled hard drive and a smart hard drive.

5. A method as defined in claim 1, further comprising:

exchanging identification information from said external device to said first gaming machine;

checking within said first gaming machine said identification information from said external device with stored authorized external device information;

exchanging identification information from said second gaming machine to said external device; and checking within said external device said identification information from said second gaming machine with stored authorized gaming machine information.

6. A method for copying configuration data from a first gaming machine to a second gaming machine, comprising:

connecting said second gaming machine to said first gaming machine via respective interface ports of said first and second gaming machines;

detecting the connecting of ports and causing a copying routine to be performed at least within said first gaming machine without human input;

determining by and within said first gaming machine without human input whether an external device connected to said first and second gaming machines is authorized to receive said configuration data;

copying at least a portion of said configuration data to said external device if said external device is authorized to receive said configuration data; and copying said configuration data from said external device to said second gaming machine only after a determination is made by said external device that said second gaming device is authorized to receive said configuration data.

7. A method as defined in claim 6, further comprising:

cross-connecting said first gaming machine to said second gaming machine wherein a transmit output of said first gaming machine is connected to a receive input of said second gaming machine and a transmit output of said second gaming machine is connected to a receive input of said first gaming machine.

8. A method as defined in claim 6, further comprising:

exchanging identification information from said external device to said first gaming machine;

checking within said first gaming machine said identification information from said external device with stored authorized external device information;

exchanging identification information from said second gaming machine to said external device; and checking within said external device said identification information from said second gaming machine with stored authorized gaming machine information.

9. A method for copying configuration data between a plurality of gaming apparatuses comprising:

sensing the connection of a first gaming apparatus from said plurality of gaming apparatuses to an external device that is physically configured to store configuration data, said configuration data comprising data related to at least one of payout related settings, wager-related settings, volume settings, display settings, credit settings and value denomination settings;

causing said configuration data to be copied from said first gaming apparatus to said external device only after a determination is made by said first gaming apparatus that said external device is authorized to receive said configuration data;

connecting said external device to one or more other gaming apparatuses of said plurality of gaming apparatuses;

automatically determining by and within said external device whether said one or more other gaming apparatuses of said plurality of gaming apparatuses are authorized to receive said configuration data when said configuration setting is copied from said first gaming apparatus with authorization of said first gaming apparatus; and copying said configuration data only to said one or more other gaming apparatuses of said plurality of gaming apparatuses that are authorized to receive said configuration data;

wherein each of said plurality of gaming apparatuses is physically configured to allow a person to input a value and make a wager and to determine a value payout based on an outcome of a game executed by said gaming apparatus.

10. A method as defined in claim 9, further comprising:

issuing a request from said external device to at least one of said gaming apparatus for said configuration data when said configuration data are uploaded from said gaming apparatus to said external device.

11. A method as defined in claim 9, further comprising:

issuing a request from at least one gaming apparatus to said external device for said configuration data when said configuration data are copied to said external device.

12. A method as defined in claim 9, further comprising:

exchanging identification information from said external device to said first gaming apparatus;

checking within said first gaming apparatus said identification information from said external device with stored authorized external device information;

exchanging identification information from said one or more gaming apparatuses of said plurality of gaming apparatuses to said external device; and checking within the external device said identification information from said one or more gaming apparatuses of said plurality of gaming apparatuses with stored authorized gaming apparatus information.

13. An apparatus comprising:

a storage device configured to interface with a communication port of each of a first gaming machine and a second gaming machine, said storage device comprising:

an interface;

a controller, and a memory;

wherein, said storage device senses, with the interface, a connecting of the device to the communication port of the first gaming machine;

upon sensing said connecting of the device, the controller automatically copies configuration data from the first gaming machine to the memory, only when said first gaming machine determines that said device is authorized to receive said configuration data;

said storage device senses, with the interface, a connecting of the device to the communication port of the second gaming machine;

the controller determines, when said storage device is connected to said second gaming machine, whether said second gaming machine is authorized to receive said configuration data; and upon determining that said second gaming device is authorized to receive said configuration data, the controller copies said configuration data from the memory to said second gaming machine.

* * * * *